US007575538B1

(12) United States Patent
Clark

(10) Patent No.: US 7,575,538 B1
(45) Date of Patent: Aug. 18, 2009

(54) COMPACT MULTI-FUNCTION EXERCISE APPARATUS

(76) Inventor: David Jon Clark, 3921 Bryant Ave. S., Apt 2, Minneapolis, MN (US) 55409

( * ) Notice: Subject to any disclaimer, the term of this patent is extended or adjusted under 35 U.S.C. 154(b) by 168 days.

(21) Appl. No.: 11/787,307

(22) Filed: Apr. 16, 2007

(51) Int. Cl.
*A63B 21/062* (2006.01)
*A63B 21/078* (2006.01)

(52) U.S. Cl. ..... 482/103; 482/138; 482/142

(58) Field of Classification Search ..... 482/92, 482/93, 99–103, 138, 142
See application file for complete search history.

(56) References Cited

U.S. PATENT DOCUMENTS

| | | | | |
|---|---|---|---|---|
| 332,989 | A | 12/1885 | Benedict | |
| 382,440 | A | 5/1888 | Sanchez | |
| 723,625 | A | 3/1903 | Thomley | |
| 2,977,120 | A | 3/1961 | Morris | |
| 4,199,139 | A | 4/1980 | Mahnke et al. | |
| 4,402,504 | A | 9/1983 | Christian | |
| 4,431,181 | A | 2/1984 | Baswell | |
| 4,549,733 | A | 10/1985 | Salyer | |
| 4,603,855 | A | 8/1986 | Sebelle | |
| 4,624,457 | A | 11/1986 | Silberman et al. | |
| 4,709,918 | A * | 12/1987 | Grinblat | 482/70 |
| 4,809,972 | A | 3/1989 | Rasmussen et al. | |
| 4,826,157 | A | 5/1989 | Fitzpatrick | |
| 4,834,367 | A | 5/1989 | Salyer et al. | |
| 4,898,381 | A | 2/1990 | Gordon | |
| 4,976,428 | A | 12/1990 | Ghazi | |
| 5,018,725 | A | 5/1991 | Cook | |
| 5,069,447 | A * | 12/1991 | Snyderman et al. | 482/133 |
| 5,082,259 | A * | 1/1992 | Gonzalez | 482/41 |
| 5,135,453 | A | 8/1992 | Sollenberger | |
| 5,211,614 | A | 5/1993 | Henes | |
| 5,328,428 | A | 7/1994 | Huang | |
| 5,462,510 | A * | 10/1995 | Ish, III | 482/142 |
| 5,466,204 | A * | 11/1995 | Nearing | 482/102 |
| 5,470,299 | A * | 11/1995 | Yeh | 482/142 |
| 5,725,459 | A | 3/1998 | Rexach | |
| 6,019,704 | A | 2/2000 | Morgan | |
| 6,217,493 | B1 | 4/2001 | Spletzer | |
| 6,315,702 | B1 | 11/2001 | Ikonomopoulos | |

(Continued)

FOREIGN PATENT DOCUMENTS

DE 19704390 A1 * 9/1997

(Continued)

*Primary Examiner*—Loan H Thanh
*Assistant Examiner*—Victor K Hwang
(74) *Attorney, Agent, or Firm*—William R. Berggren

(57) ABSTRACT

An exercise apparatus that provides a complete body workout, folds up into a small footprint, and can be hidden inside of a closet or decorative cabinet. The apparatus has an arm assembly with two arms pivotally attached to a guide assembly that translates vertically within a frame assembly to a multitude of locations. At the free ends of the arms are cable ends that allow an exercise bar or handgrips to be attached to a resistance assembly. Rotating pulley assemblies there allow the cables to exit the arms freely. The cable ends move independently of each other, which simulates working out with free weights. A counterweight offsets the weight of the arm and guide assemblies to permit easy positioning of the arm assembly for different exercises. A counterweighted fold out seat assembly with lower member completes the versatile and compact workout station.

20 Claims, 17 Drawing Sheets

U.S. PATENT DOCUMENTS

| | | | | |
|---|---|---|---|---|
| 6,443,877 | B1 * | 9/2002 | Hoecht et al. | 482/103 |
| 6,447,430 | B1 | 9/2002 | Webb et al. | |
| 6,458,061 | B2 | 10/2002 | Simonson | |
| 6,488,612 | B2 | 12/2002 | Sechrest et al. | |
| 6,592,498 | B1 | 7/2003 | Trainor | |
| 6,685,601 | B1 | 2/2004 | Knapp | |
| 6,755,770 | B2 | 6/2004 | Martens | |
| 6,921,355 | B2 * | 7/2005 | Campanaro et al. | 482/95 |
| 2002/0091043 | A1 | 7/2002 | Rexach | |
| 2003/0045406 | A1 | 3/2003 | Stone | |
| 2003/0176261 | A1 | 9/2003 | Simonson et al. | |
| 2004/0005966 | A1 | 1/2004 | Chen | |
| 2004/0018920 | A1 | 1/2004 | Simonson | |
| 2005/0096197 | A1 | 5/2005 | Webber et al. | |
| 2006/0189457 | A1 * | 8/2006 | Ripley | 482/99 |

FOREIGN PATENT DOCUMENTS

| | | | |
|---|---|---|---|
| DE | 19801672 | A1 * | 11/1998 |

* cited by examiner

COMPACT MULTI-FUNCTION EXERCISE APPARATUS

CROSS REFERENCE TO RELATED APPLICATIONS

This application claims the benefit of Provisional Patent Application No. 60/565,384 filed 2004 Apr. 26 by David Clark and of Utility Patent Application No. 11/114,450 filed 2005 Apr. 26 by David Clark now abandoned.

FIELD OF THE INVENTION

This invention relates to multi-purpose exercise equipment that uses cables to transfer force from a weight stack to user interfaces and also to apparatus that have elements that pivot, translate, and transfer forces with cables.

BACKGROUND OF THE INVENTION

There are mainly two different methods to do strength training and both have their inherent strengths and weaknesses. The first is to exercise with free weights and the second is to exercise with exercise machines that use cables to transfer the weight from a resistance source to a user.

The advantage of free weights is that they're very effective in producing strength gains and muscle mass. This is, in part, because the weight is unguided, and therefore secondary muscles get involved during the exercise in order to balance the weight. One of the inherent problems with free weights is that exercising with them is not as safe as exercising with an exercise machine. A lifter can lose his balance and be injured in a fall. The lifter may not be able to finish a lift, in which case he can become pinned under a bar. Plates can slide off the bar during a lift, potentially causing injury to the lifter and most likely to the floor. Lifting with free weights is also time consuming because of the need to take weight plates on and off to change the resistance, and because of the need to move the bar to different positions on the bar rack for different exercises. Also the lifting area can become cluttered with weight plates, thereby causing a hazard and making it difficult to locate desired weigh plates. In addition, some body parts are best worked out with an exercise machine, such as using a cable pulldown machine for working out the back. Furthermore, cost can be a factor. A lot of equipment is needed to be able to do a complete free weight workout, such as, the free weights, dumbbells, various lifting bars, a bench that inclines and declines, a bar rack for holding the barbell in several locations, and a cable pulldown machine. Purchase of all of this equipment can get quite expensive. Since free weights and free weight equipment are not designed to be compact or stored out of view, typically a whole room needs to be dedicated to such a setup.

Some of the advantages of exercise machines that make them so popular are that they overcome many of the disadvantages of free weights. They're safer to use than free weights as there is no risk of falling, of being trapped by the weights, or of having the weights fall off. Because the means of resistance is typically a weight stack where the weights are confined, the weights don't get scattered, lost, or dropped on the floor, and changing the amount of weight is quickly achieved by just changing the position of the selector pin. Many different exercises can be performed on one machine, and some exercise machines have multiple workout stations and weight stacks to permit performance of the various exercises needed for a complete body workout. Since it is possible to quickly and easily change between different exercises and resistance levels, circuit weight training is possible.

Circuit weight training was developed to promote both aerobic and muscular fitness at the same time. It consists of a series of exercises performed in succession, with a maximum of 30 seconds of rest between exercises, and lasting a total of 30 minutes. In order to maintain such a pace, an exercise machine must allow for a very quick and smooth transition between the different exercises and resistance levels, or there needs to be many different workout stations to allow all the different exercises needed to get a full body workout.

One of the problems with exercise machines is that they take up a lot of floor space. While some take up a smaller amount of floor space than others, typically they are all free standing and need to be set up far enough away from walls and furniture in order to allow for the space necessary to move around them and to exercise freely. Most exercise machines are designed such that only a certain number of body parts can be exercised per workout station. This is because the typical workout station is dedicated to doing specific exercises, such at a high pull station for doing pulldowns, or a low pull station for curls, or a station dedicated to doing the bench press or squats, etc. Exercise machines with multiple stations are larger machines that require more steel, pulleys, and parts, resulting in a more complicated and expensive exercise machine that takes up more floor space.

Some inventions have attempted to deal with the problem of dedicated workout stations by allowing the pull point to be adjustable in space. Some have achieved this by allowing the pull point to be adjusted vertically such as shown in U.S. Pat. Nos. 2,977,120; 4,402,504; 4,549,733; 4,603,855; 4,834,367 and 4,898,381. One of the problems to be overcome by doing this is what to do with the excess cable as the pull point is moved. Another method to adjust the pull point in space is to position the pull point at the end of an arm, which pivots from a fix point on the frame of the machine as shown in U.S. Pat. Nos. 4,826,157, 6,458,061 and 6,488,612. Cable length is constant but the arms pivot from a fixed pivot point.

Another problem with exercise machines is that during the performance of some of the pressing exercises or fly motion exercises, the path of travel for the exercise follows a predefined arc or guide-way. Such single plane motion eliminates or substantially reduces the amount of work that smaller secondary muscles would be required to do to balance the weight if the same exercise was being performed using free weight exercises.

Some machines require extra time in selecting a resistance level, especially those that utilize progressive resistance means such as springs, elastic band resistance, or flexible members to provide the resistance. These means of resistance are generally not as preferred by serious athletes for muscle development, who instead prefer the constant resistance offered by free weights or stack weight machines. If a machine takes a long time to be setup for different exercises and resistance settings, circuit training cannot be performed, and the workout is longer than otherwise needed.

Another problem with existing exercise machines is that they detract from a room that is not specifically dedicated for exercise. Most exercise machines aren't designed to be hidden from view when not in use, which can be unsightly for a room that is not specifically dedicated to be a fitness room. Some gyms are designed to fold up when not in use to cut down on the space they take up, but they're often too heavy and/or bulky to move or store away from view. There are some home gyms that fold up and can be stored out of sight, perhaps under a bed. But these require substantial time and effort to unfold for a workout and then fold up again afterwards. In addition, these fold-up gyms often fail to provide a full body workout.

SUMMARY OF THE INVENTION

I have invented a versatile exercise apparatus that is compact. The exercise apparatus comprises a guide assembly, an arm assembly, a resistance assembly, and a cable assembly. The guide assembly is able to slide along a guide path that has an axis of translation, a first guide end and a second guide end. The arm assembly is pivotally coupled to said guide assembly, has an axis of rotation perpendicular to said axis of translation, and comprises a first arm and a second arm, each containing a pivot end proximate its pivot point and a distal end. The resistance assembly includes a source of force and a selective means of engaging a portion of said source of force. The cable assembly means for transferring force comprises a first cable end extending from the distal end of the first arm and a second cable end extending from the distal end of the second arm, such that said first cable end and said second cable end are in communication with the source of force.

I have also invented an exercise apparatus able to be stored in a cabinet. The apparatus includes a frame, a guide assembly, an arm assembly, a resistance assembly, a cable assembly, a backrest and a seat, wherein the apparatus is collapsible. The frame has a left, center, and right member wherein the members are substantially parallel to each other, and the center member has a top end that is able to pivot. The guide assembly is able to slide along a guide path that is formed by the left and right member, and has an axis of translation, a first guide end and a second guide end. The arm assembly is pivotally coupled to said guide assembly, has an axis of rotation and rotation sufficient to permit positions suitable for exercise activity when in an open position and alignment substantially parallel and proximate to the plane of translation when in a closed position. The arm assembly also comprises a first arm and a second arm, each containing a pivot end proximate its pivot point and a distal end. The resistance assembly includes a source of force and a selective means of engaging a portion of said source of force. The cable assembly means for transferring force comprises a first cable end extending from the distal end of the first arm and a second cable end extending from the distal end of the second arm, such that said first cable end and said second cable end are in communication with the source of force. The backrest has a top and a bottom wherein the backrest is slideably attached to the center member. The seat has a top and a bottom, where the top of the seat is rotateably attached to the bottom of the backrest to permit an alignment that is approximately perpendicular to the backrest in an open position and substantially parallel to the backrest in a closed position. The exercise apparatus in the open position is suitable for exercise activity and in a closed position is suitable for storage in a space having minimal depth.

I have also invented an exercise apparatus with a novel collapsible seat. The assembly includes a frame, a backrest and a seat. The frame has a center member that has a top end that is able to pivot. The backrest has a top and a bottom wherein the backrest is slideably attached to the center member. The seat has a top and a bottom, where the top of the seat is rotateably attached to the bottom of the backrest to permit an alignment that is approximately perpendicular to the backrest in an open position and substantially parallel to the backrest in a closed position.

The benefits of the invention relate to its versatility and compactness. Many different exercises can be done on this piece of equipment. As a result, additional exercise equipment is unnecessary. Various exercises can be performed with minimal changeover time. This permits circuit training. The apparatus is designed to collapse into a space having a minimum depth. Thus, the apparatus is suitable for folding up into a cabinet, which allows the room to be used for other activities. The collapsible seat also has advantages by itself in situations where space is a premium. These include such situations as, for example, buses and airplanes. Other advantages will be apparent from the following description and drawings of several embodiments.

BRIEF DESCRIPTION OF THE DRAWINGS

The drawings are briefly described below.

Figure 1:
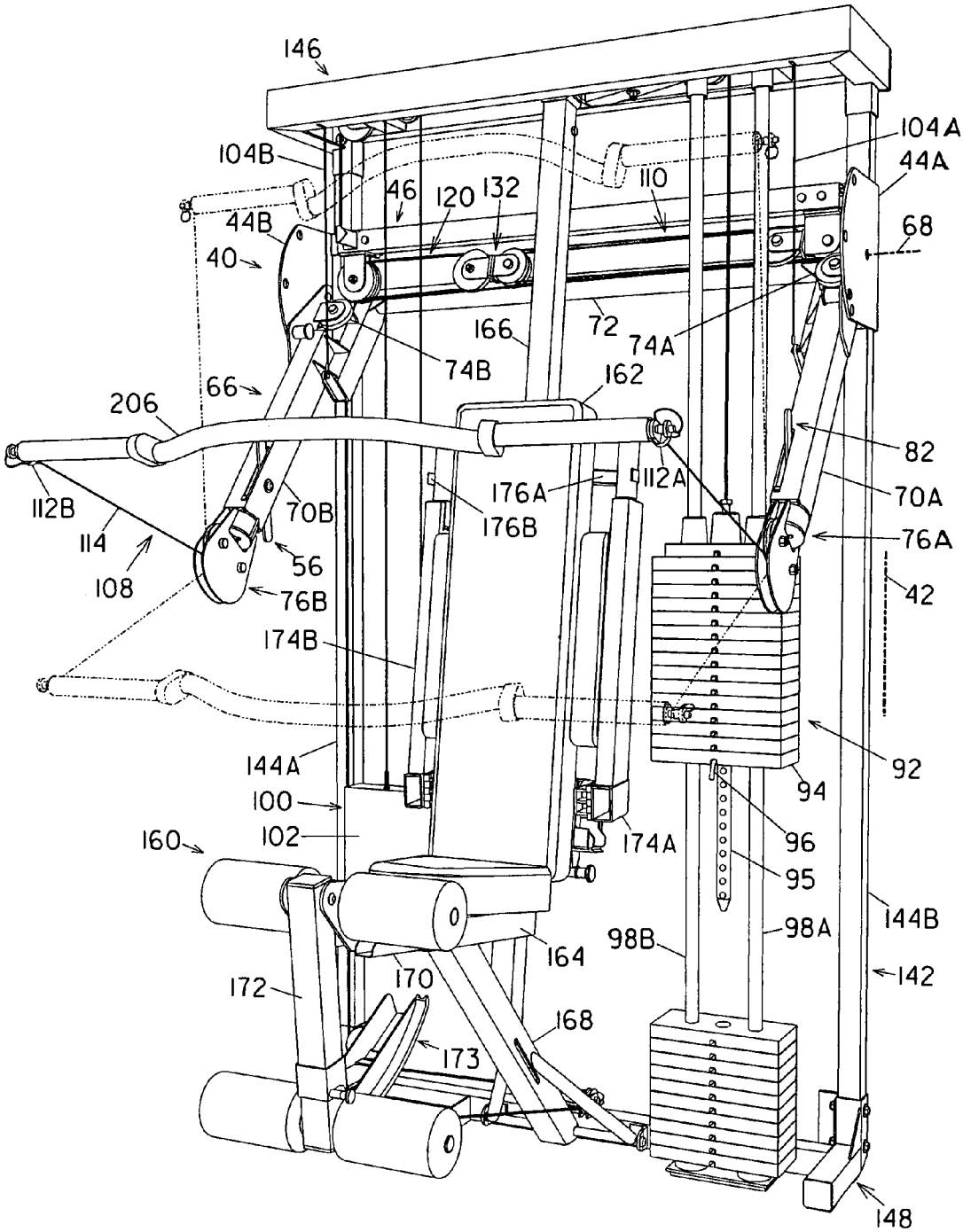
FIG. 1 is a front perspective view of an exercise machine embodiment of the invention with cabinet enclosure, counterweight guide, and back panel removed. The seat assembly is down, the arm assembly is pivoted in front of the backrest and the exercise bar is extended like it would be at the end of an incline bench press exercise. Also shown in phantom are images of the bar extended in a military press and a decline bench press.

For FIGS. 10-13 the nomenclature on the drawing is as follows: A: arm mounted; G: guide mounted; F: frame mounted.

Figure 5:
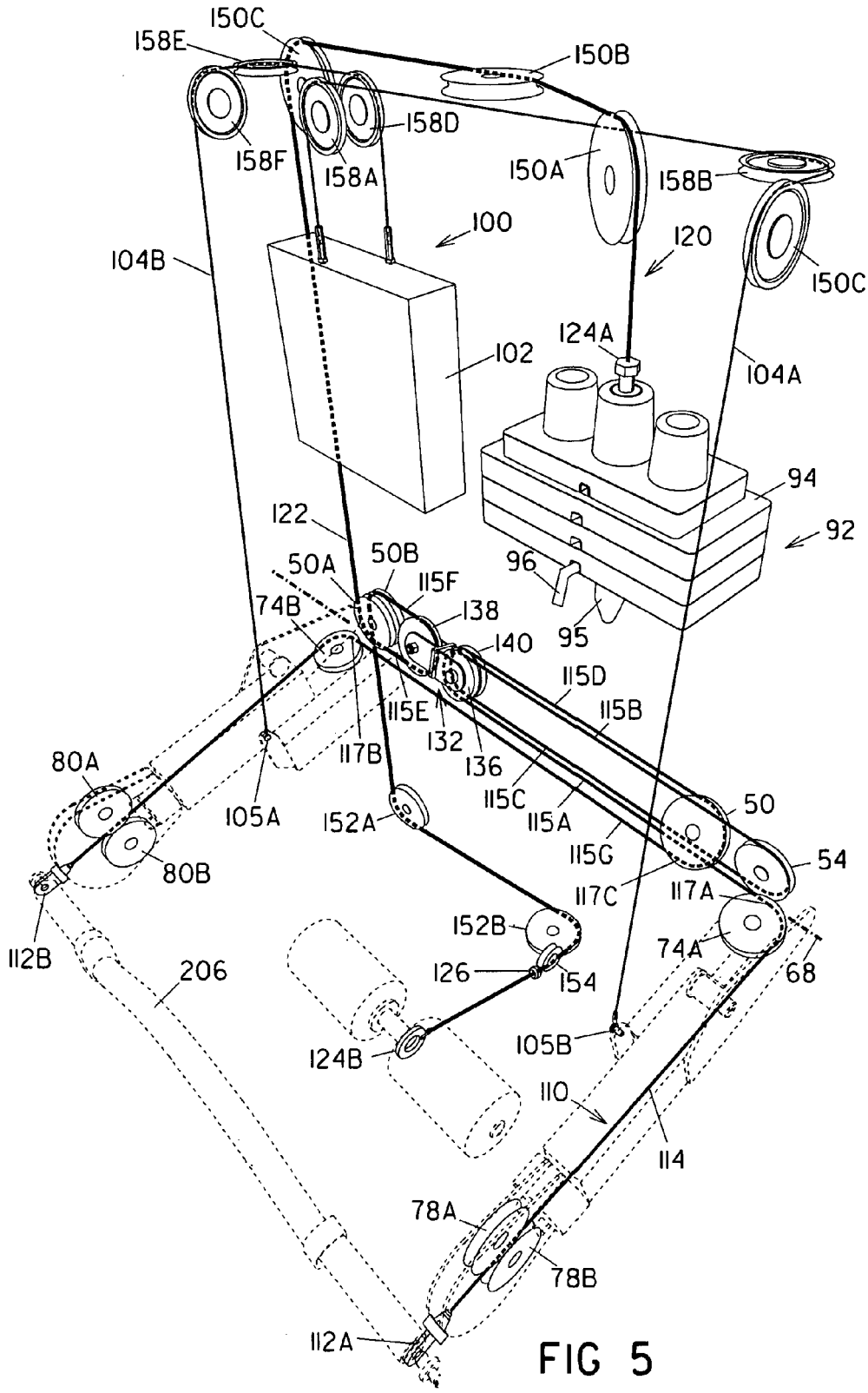
FIG. 5 is a front/side perspective view of an embodiment showing the arm assembly in phantom, the cable assembly means of transferring forces, and the counterweight assembly.
Figure 6:
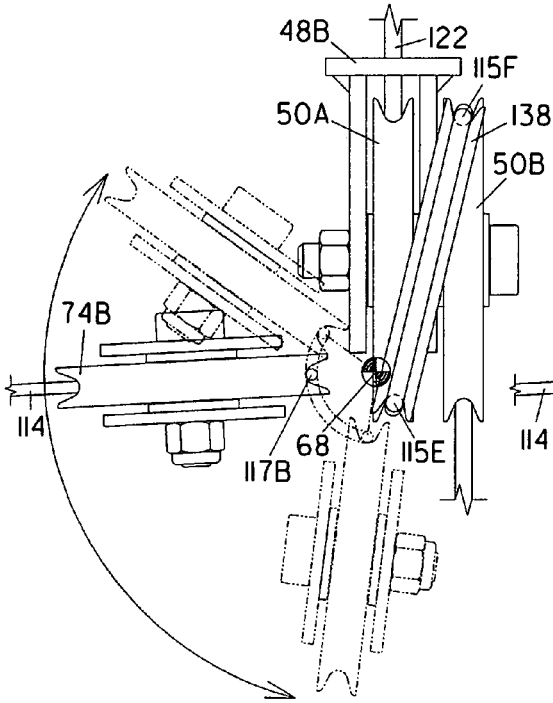
FIG. 6 is a section view from FIG. 4 showing the resistance cable reeving and clearance with the second pulley.
Figure 10:
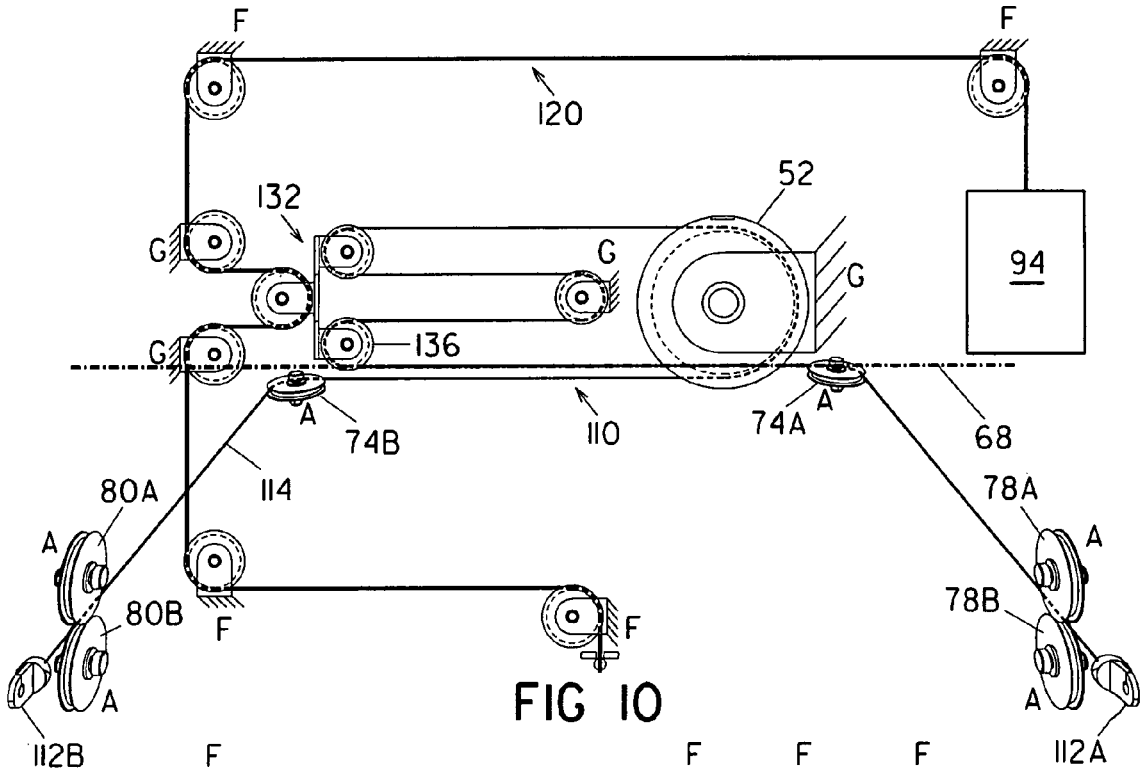

FIG. 10 is a schematic representation of the cable reeving of FIG. 5.

Figure 11:
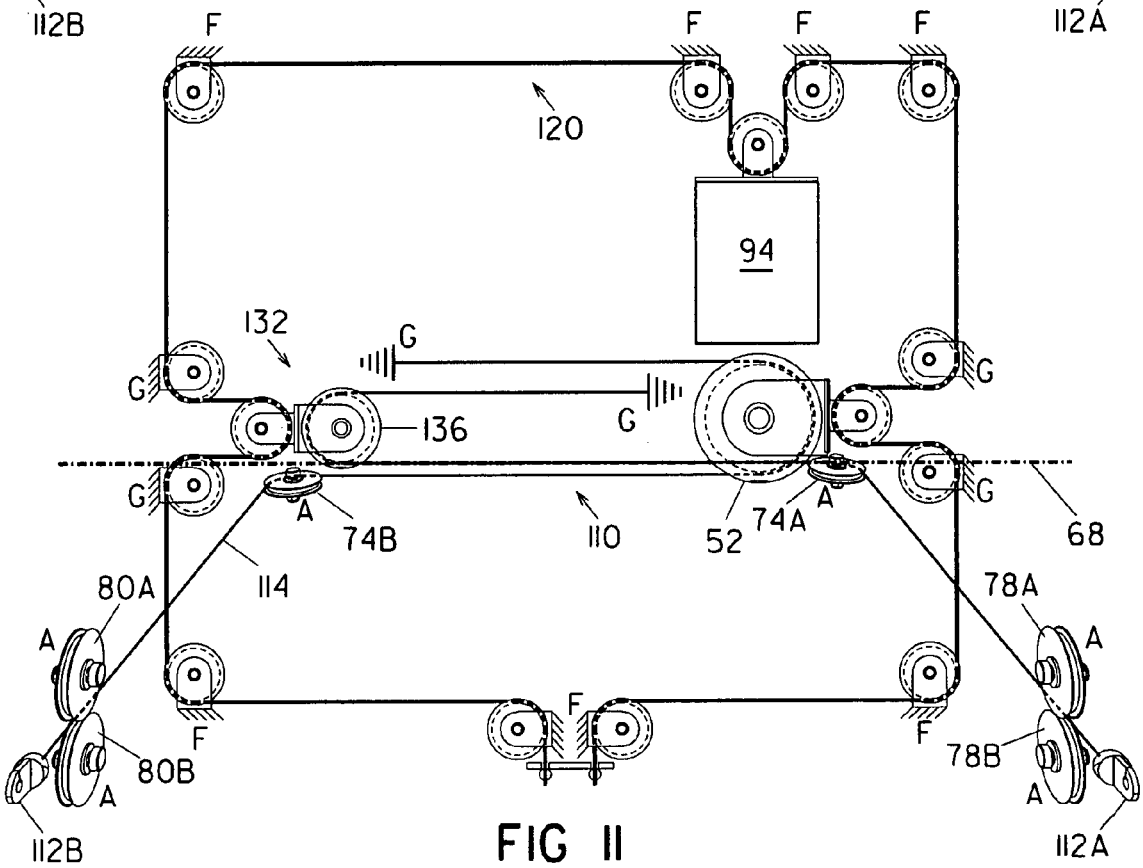

FIG. 11 is a schematic representation of an alternative cable reeving method that has two pulley blocks as part of the pulley block assembly.

Figure 12:
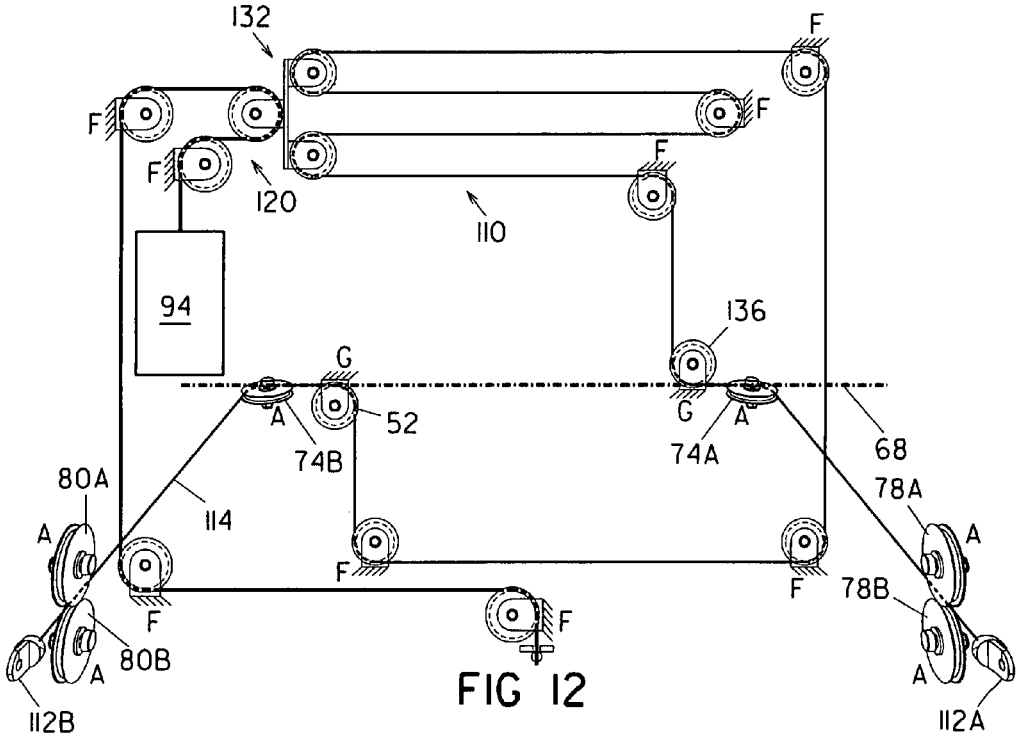

FIG. 12 is a schematic representation of an alternative cable reeving method that has a pulley block assembly running horizontally in a location other that between the arms.

Figure 13:
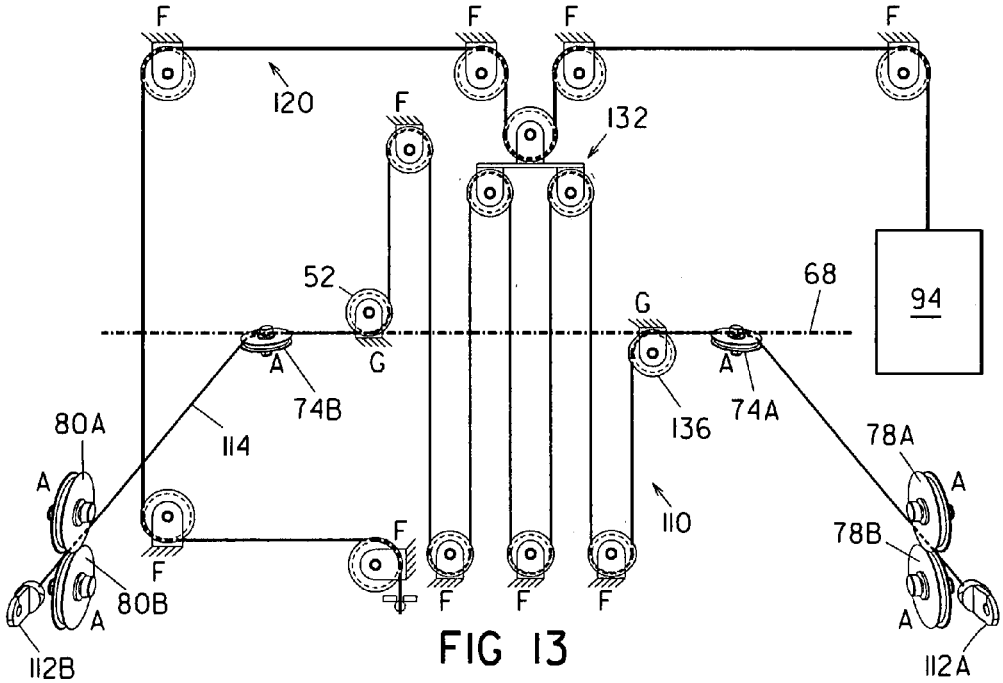

FIG. 13 is a schematic representation of an alternative cable reeving method that has a pulley block assembly running vertically.

Figure 14:
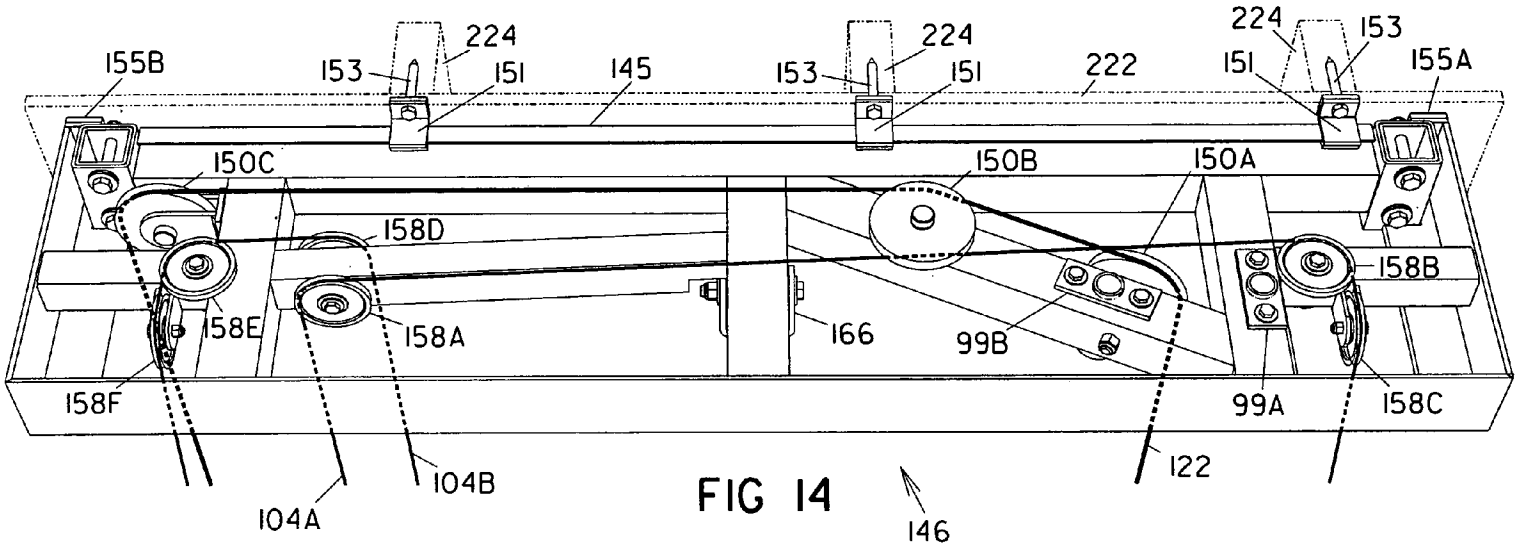

FIG. 14 is a front/top perspective view of an embodiment showing the top frame assembly.

Figure 15:
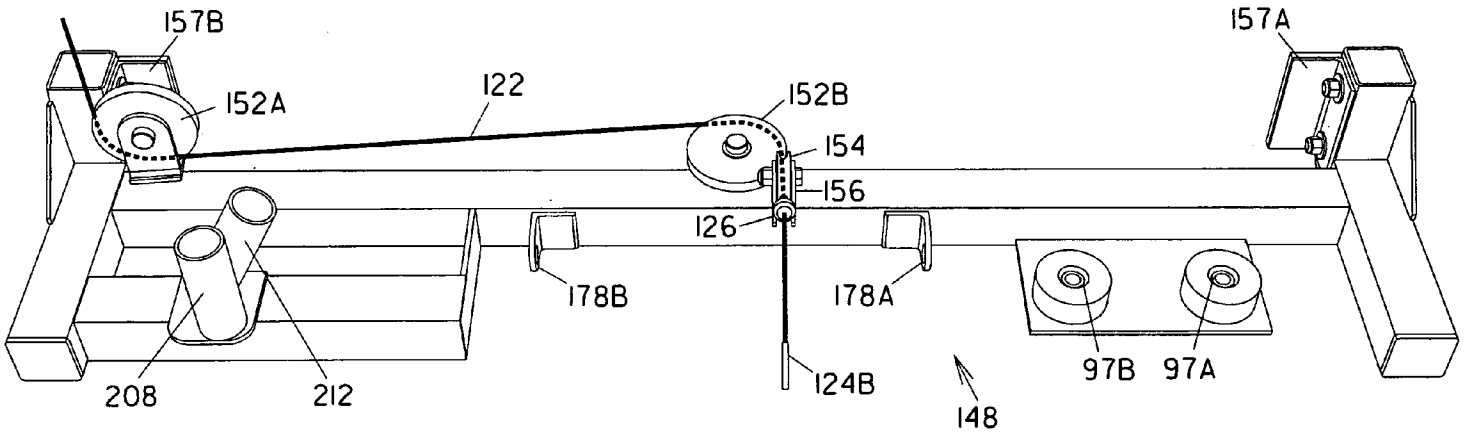

FIG. 15 is a front/top perspective view of an embodiment showing the bottom frame assembly.

Figure 16:
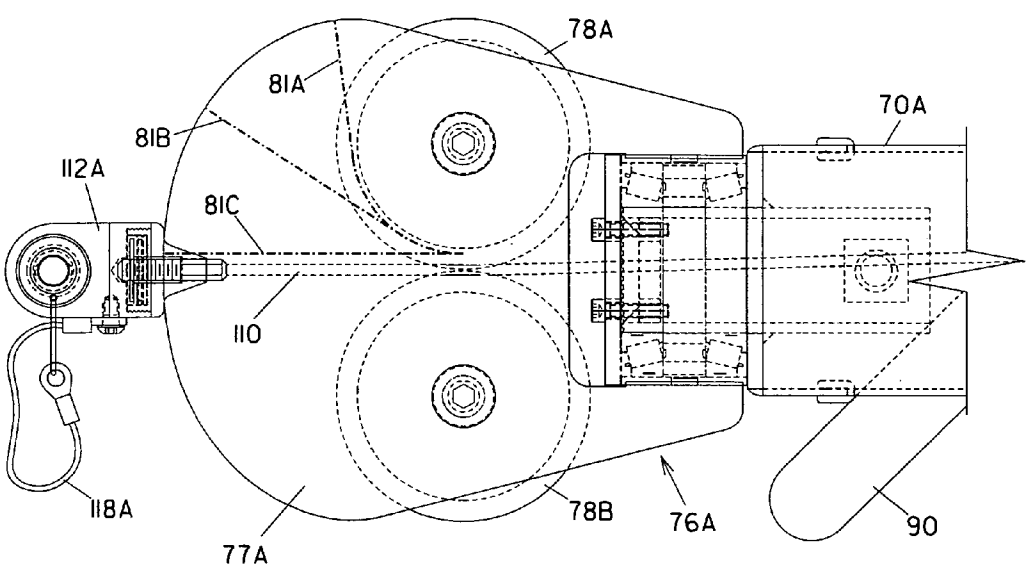

FIG. 16 is a side view of a pulley assembly of an embodiment

Figure 17:
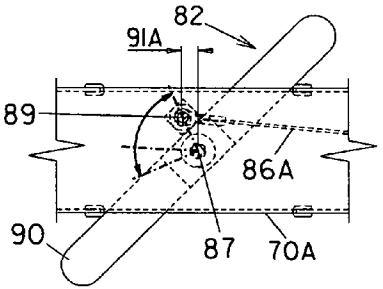

FIG. 17 is a side view of an activation lever of an arm of an embodiment positioned so that the lock pin assemblies are engaged.

Figure 18:
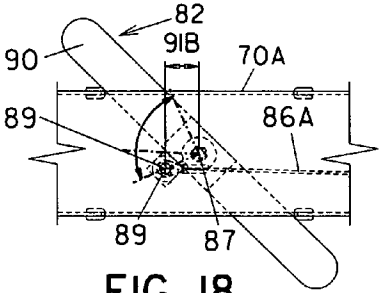

FIG. 18 is a side view of an activation lever of the arm of the embodiment of FIG. 17 positioned so that the lock pin assemblies are disengaged.

Figure 19:
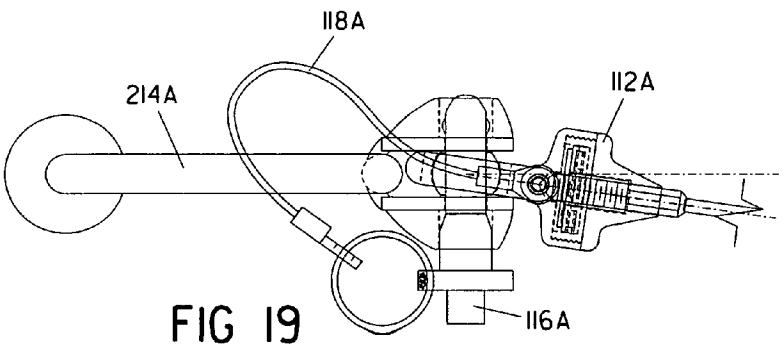

FIG. 19 is a view of an embodiment showing a handgrip attached to a cable end.

Figure 20:
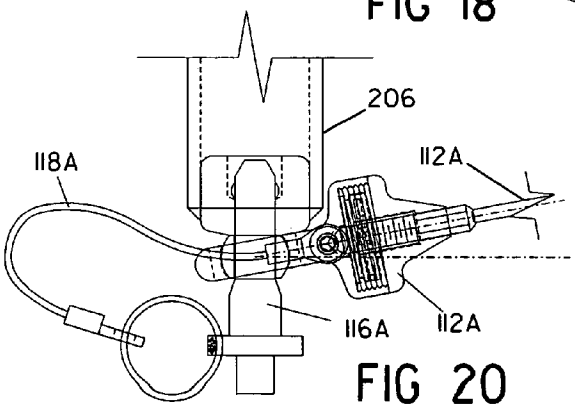

FIG. 20 is a view of an embodiment showing one end of an exercise bar attached to a cable end.

Figure 21:
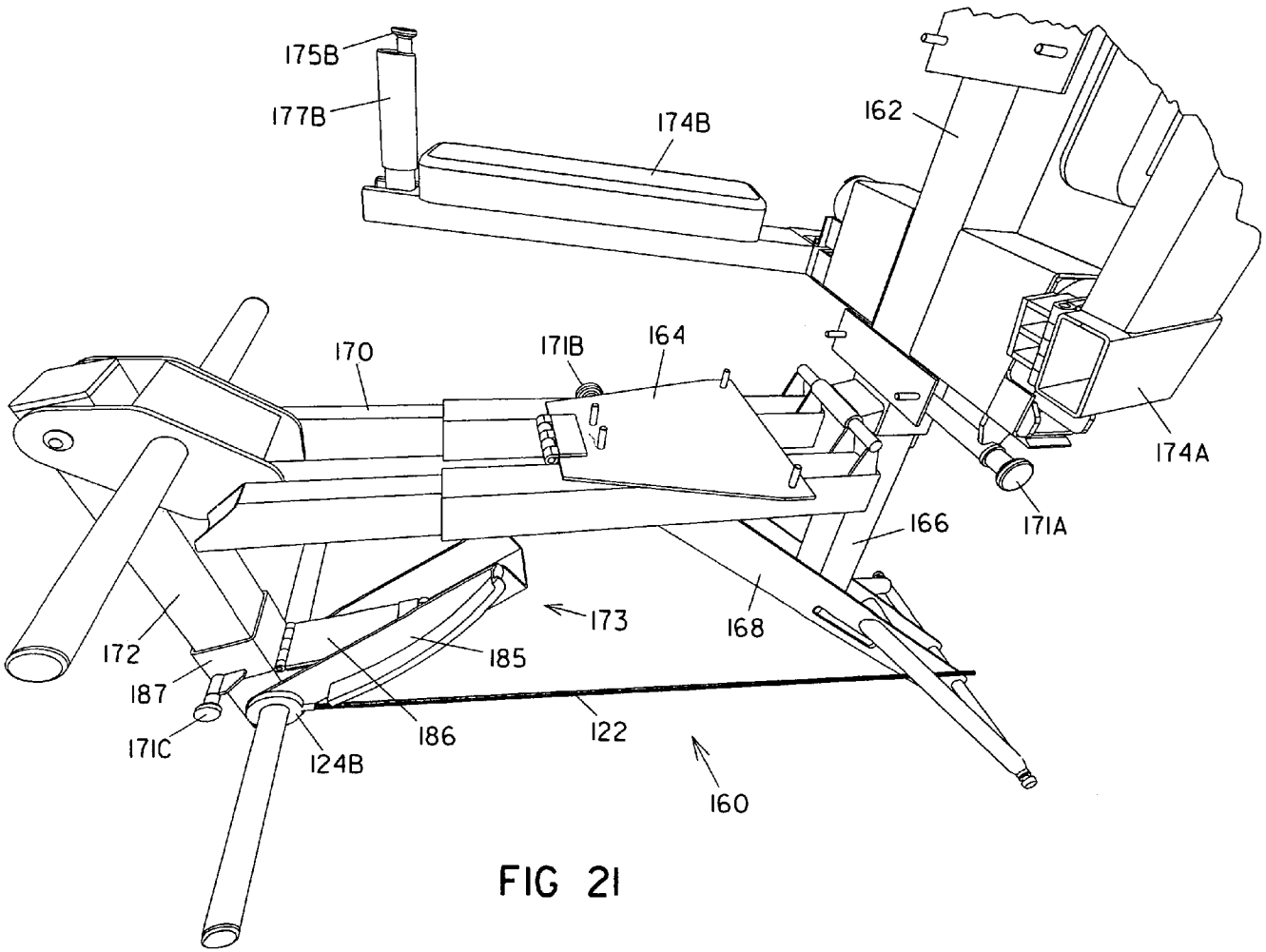

FIG. 21 is a side perspective view of an embodiment of the seat assembly in its folded out position with the seat pad, backrest pad, thigh cushions, and ankle cushions removed for clarity. One of the Roman chair arms is down and the grip for that arm is shown in its raised position.

Figures 22, 23, 24:
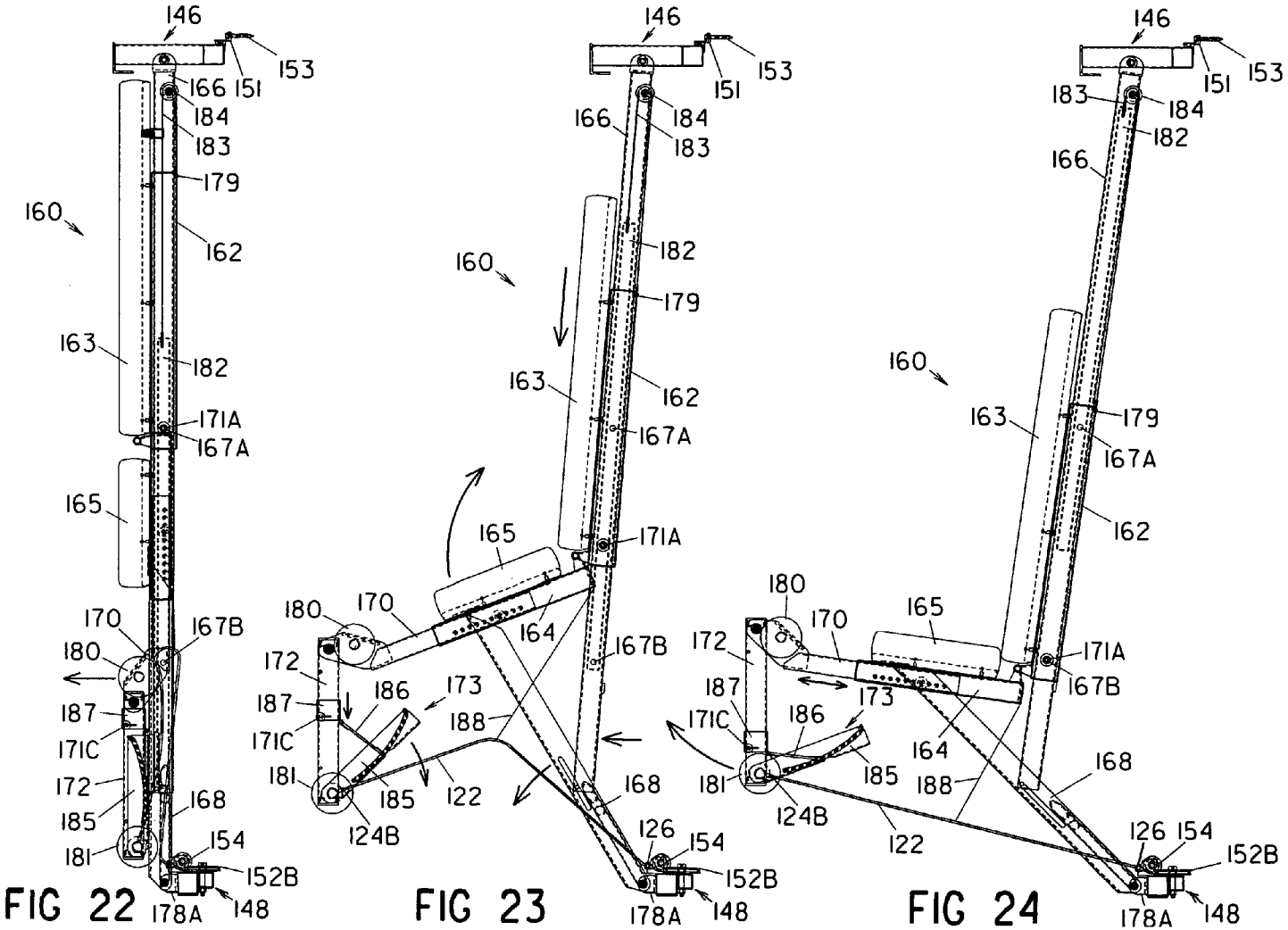

FIG. 22 is a side view of the seat of FIG. 21 in its storage position.

FIG. 23 is a side view of the seat of FIG. 21 midway between its storage and operational positions.

FIG. 24 is a side view of the seat of FIG. 21 folded down into its operational position.

Figure 25:
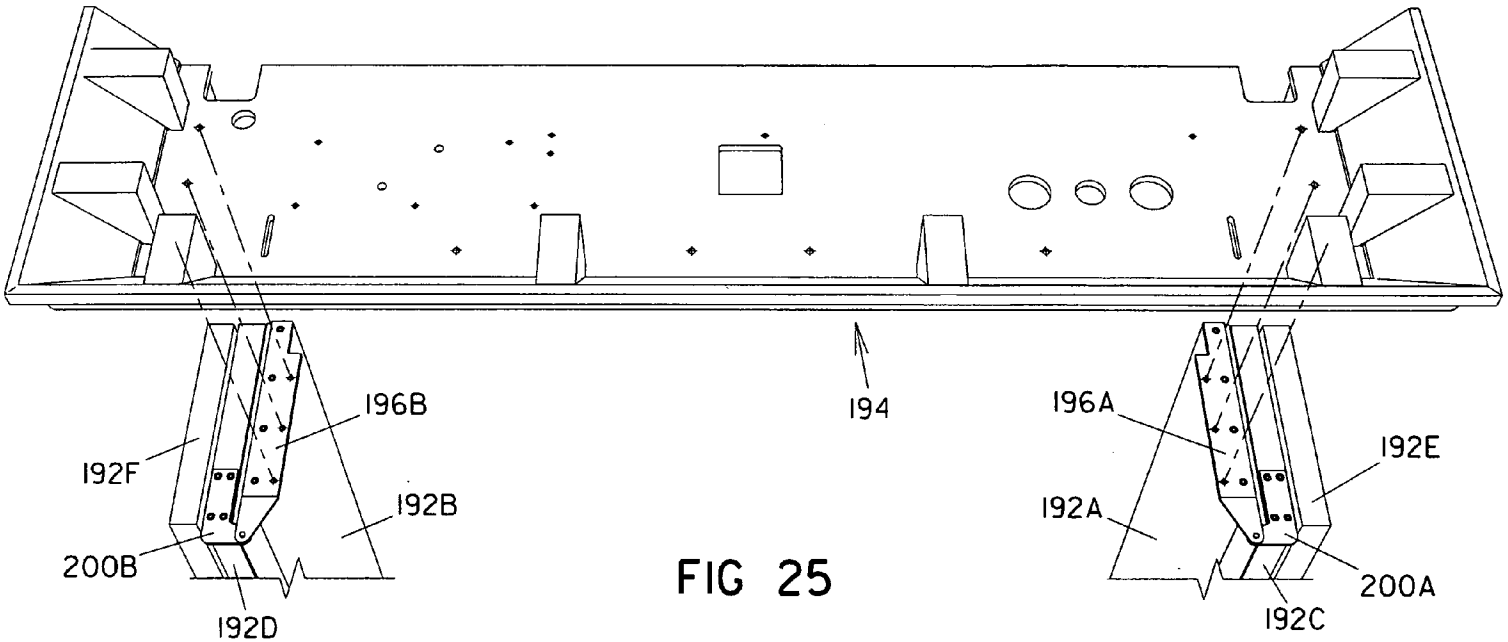

FIG. 25 is a front/top perspective view of an embodiment showing the cove assembly of a cabinet enclosure and how the side door panels mount to it.

Figure 26:
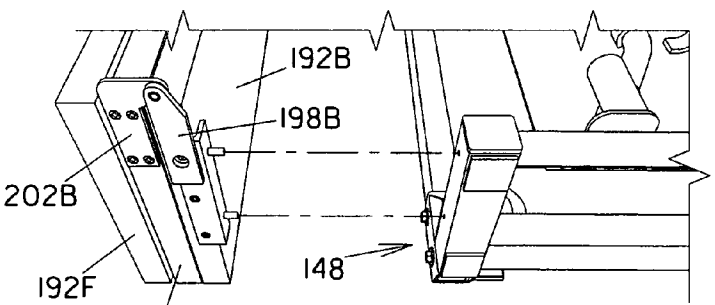

FIG. 26 is a bottom perspective view of the embodiment of FIG. 25 showing how a side door panel mounts to bottom frame assembly.

Figure 27:
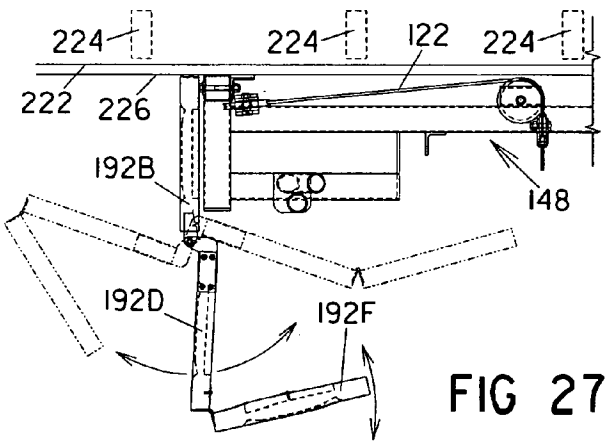

FIG. 27 is a plan view of the left half of the cabinet enclosure of the embodiment of FIG. 25 and shows how the front door panels move.

Figure 28:
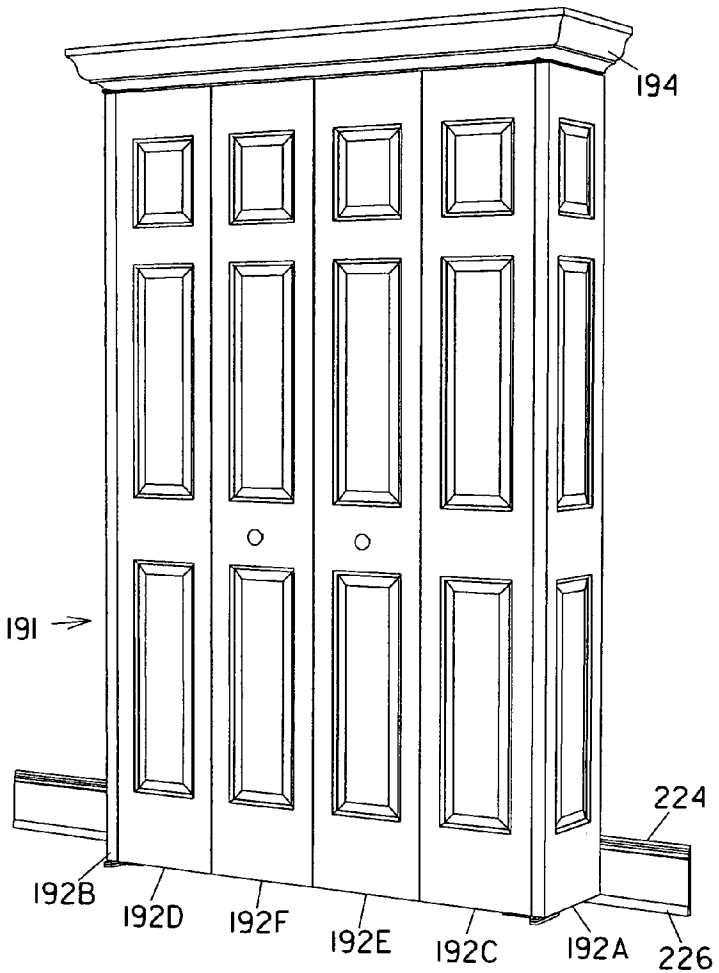

FIG. 28 is a perspective view of an embodiment showing the exercise apparatus in its storage position with a cabinet enclosure closed around it.

Figure 29:
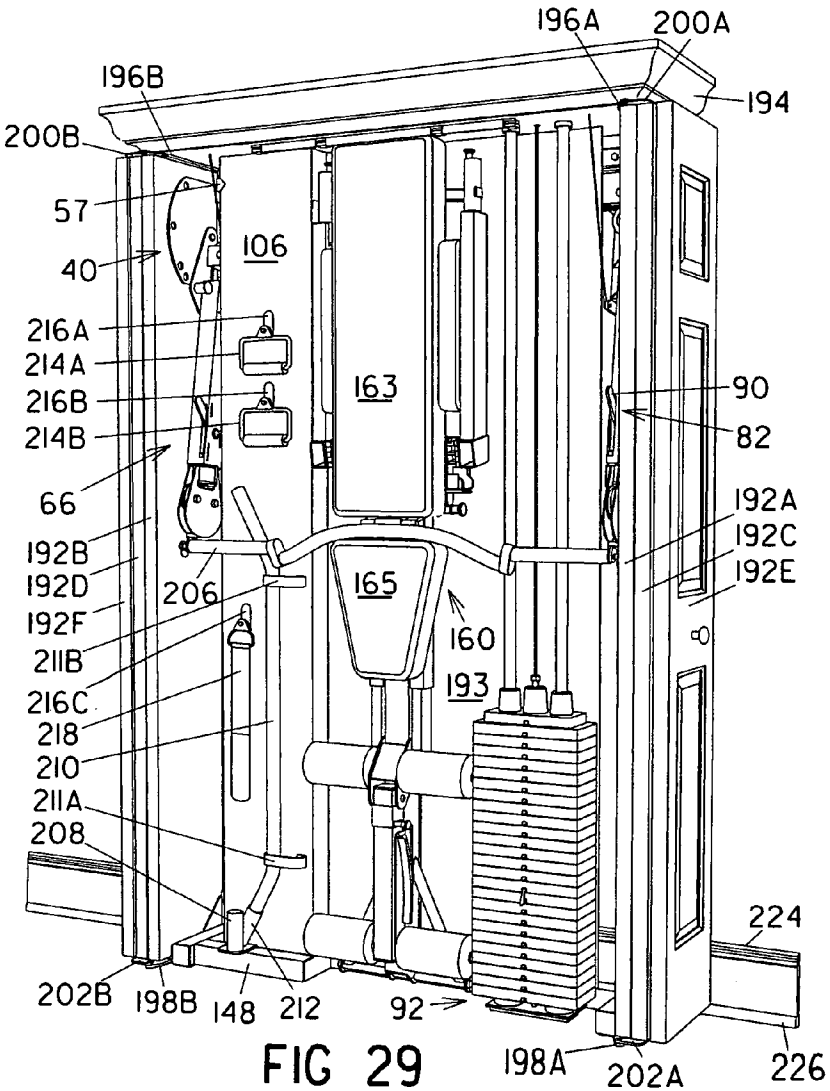

FIG. 29 is a perspective view of the embodiment of FIG. 28 showing how the exercise apparatus looks just after the door panels for the cabinet enclosure are put into their open position.

Figure 30:
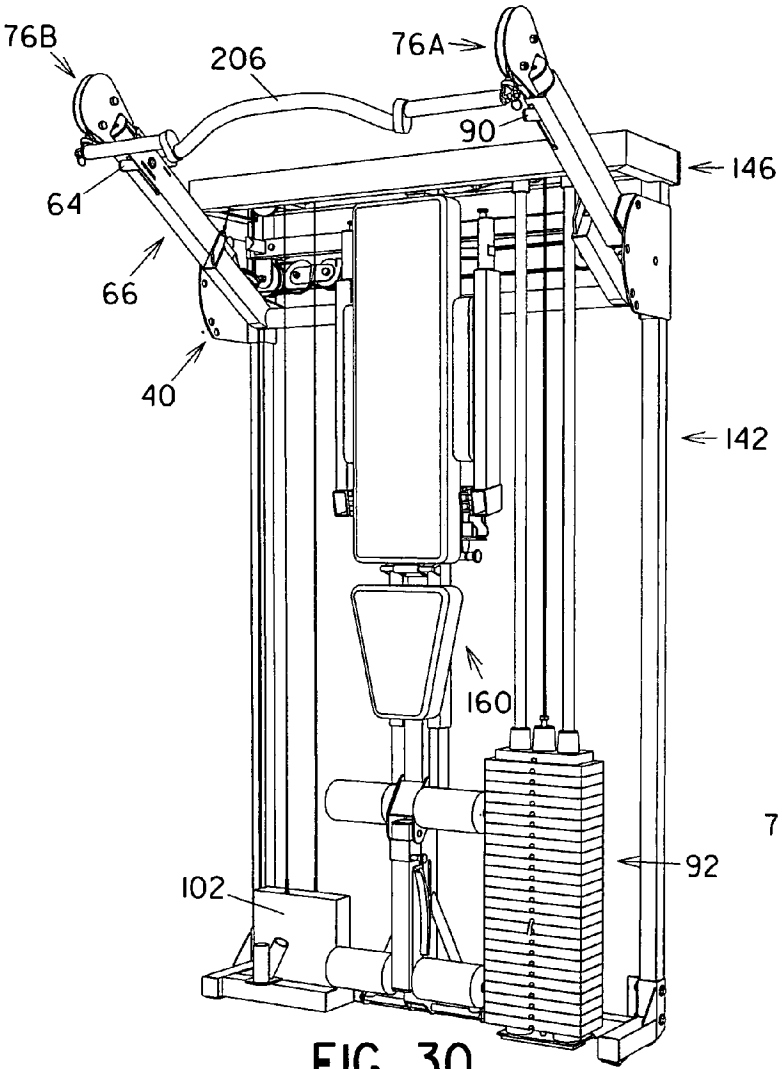

FIG. 30 is a perspective view of an embodiment showing the exercise apparatus bare (cabinet enclosure, counterweight guide and back panel removed to show more detail) and with the arm assembly rotated up to its highest position.

Figure 31:
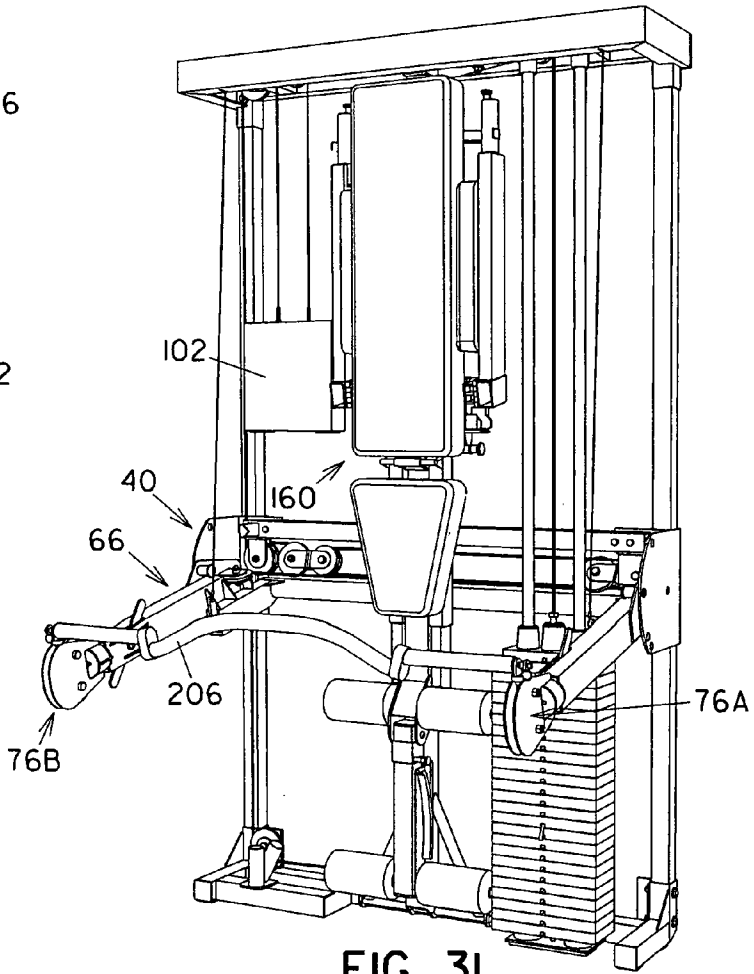

FIG. 31 is a perspective view of the embodiment of FIG. 30 showing the exercise apparatus bare with the arm assembly leveled out and into a lower position.

Figure 32:
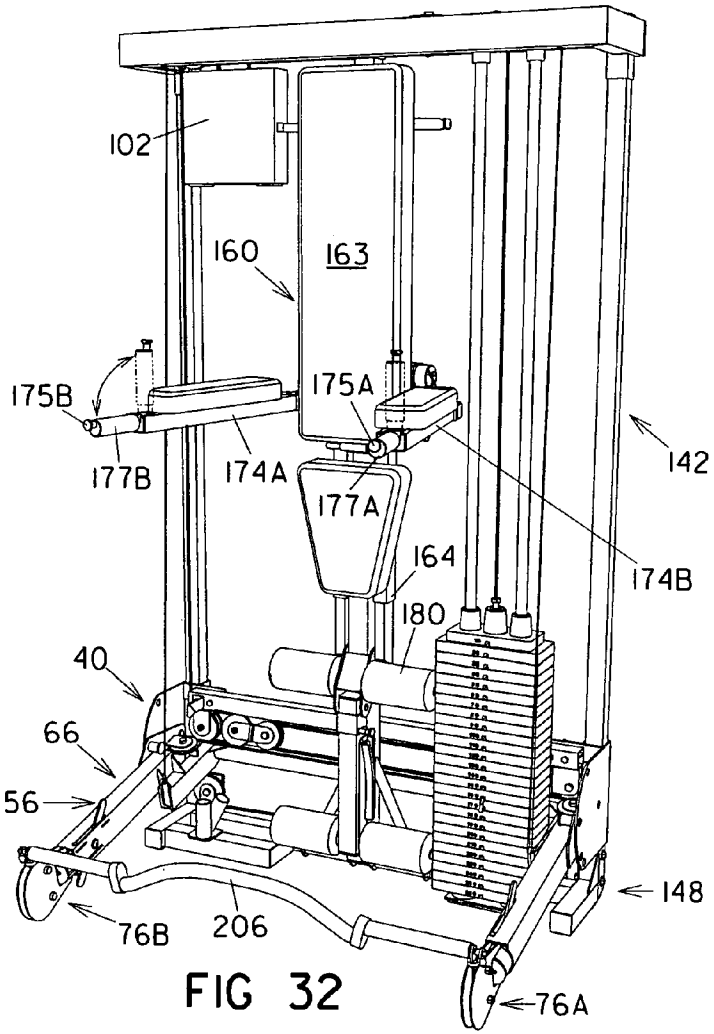

FIG. 32 is a perspective view of the embodiment of FIG. 30 showing the exercise apparatus bare with the arm assembly lowered to its lowest position.

Figure 33:
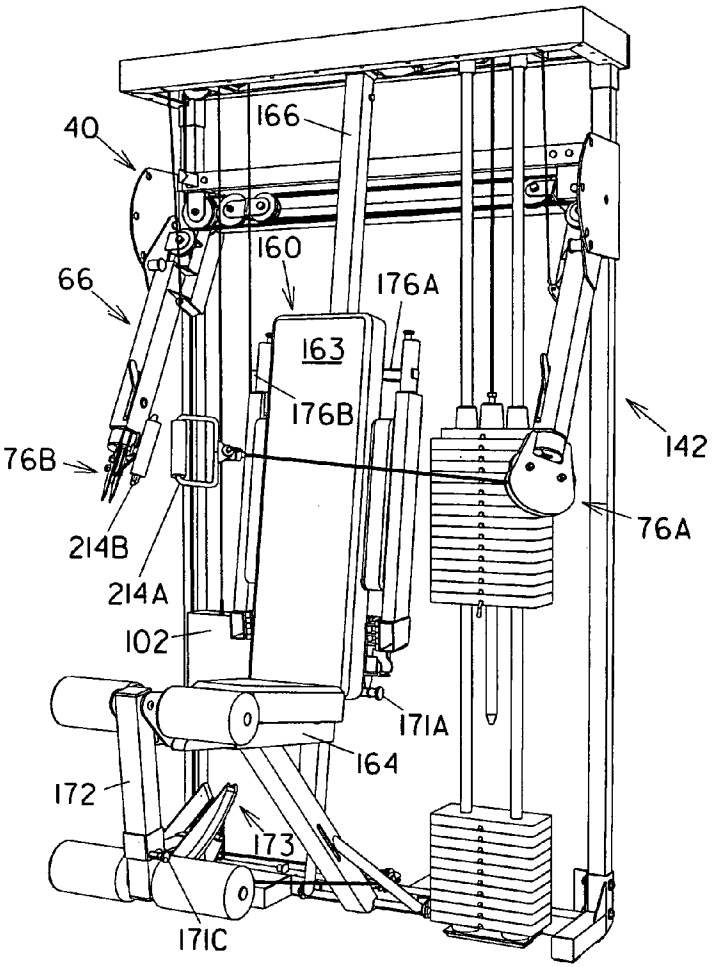

FIG. 33 is a perspective view of the embodiment of FIG. 30 showing the exercise apparatus bare with the seat assembly folded down to its operation position, the arm assembly is moved to the bench fly position, and the exercise bar is swapped out for handgrips.

Figure 34:
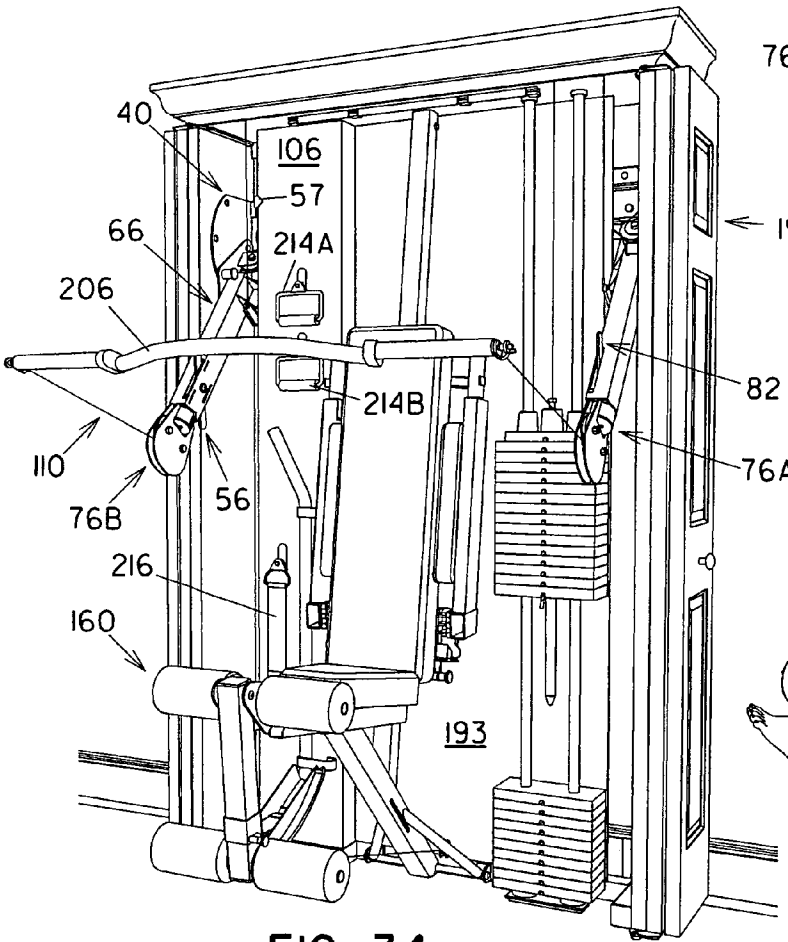

FIG. 34 is a perspective view of the embodiment of FIG. 29 showing the exercise apparatus with the arm assembly moved to the bench press position with the exercise bar attached.

Figure 35:
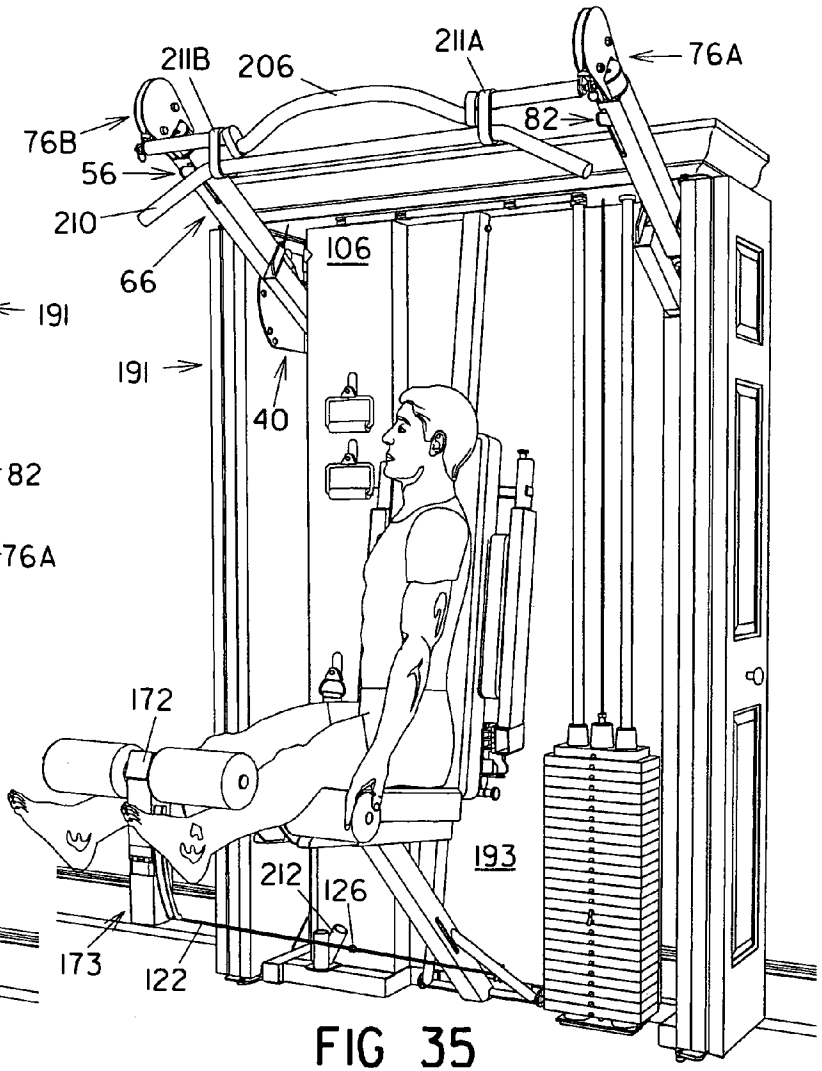

FIG. 35 shows the arm assembly of the embodiment of FIG. 29 raised to its highest position with the pulldown bar installed and a person using the leg extension.

DETAILED DESCRIPTION OF THE INVENTION

A preferred embodiment of the present invention provides a multi-function exercise apparatus comprising: a guide assembly, which translates vertically within a wall mounted frame assembly; an arm assembly comprised of two arms that are pivotally attached to the guide assembly; a resistance assembly comprised of a single weight stack; and a cable assembly means for transferring force from the resistance assembly to the cable ends located at the distal ends of the arm assembly. The cable assembly means allows the arm and guide assemblies to rotate and translate without effecting cable length. Other components of the invention may include: a counterweight assembly to offset the weight of the arm and guide assemblies to make effortless their rotation and translation; a seat assembly with leg extension and Roman chair arms that folds out for use and then folds up into a compact area when not in use; locking means for locking the arm assembly in fixed rotation and the guide assembly in a specific translation position; rotating pulley assemblies at the ends of the arms that allow for cable crossovers and other specialty exercises; and a decorative cabinet for enclosing the entire exercise apparatus when not in use. The cabinet takes up a minimum of floor space. The following discussion will focus on structural elements and operational aspects.

Structural Elements

Various embodiments of the invention will be discussed to illustrate different aspects of the invention. It is understood that embodiments may include some or all of the components and features discussed below. While many of the figures are of different embodiments, the following discussion will be as though most are of one embodiment.

One embodiment of the exercise apparatus is shown in FIG. 1 and in FIG. 28. Overviews of the major components that can comprise one or more embodiments of an exercise apparatus of the invention are listed below. Later in the description more detail is given to each of the components. The major components of the exercise apparatus of these embodiments include: an arm assembly 66 that is pivotally attached to a guide assembly 40, which is free to translate vertically along a wall mounted frame assembly 142; a resistance assembly 92 that is connected to the arm assembly 66 by a cable assembly means 108, that includes a pulley block assembly 132, an arm cable assembly 110 and a resistance cable assembly 120; a counterweight assembly 100; a seat assembly 160; a cabinet enclosure 191 (FIG. 28); and an assortment of user interfaces.

Figure 2:
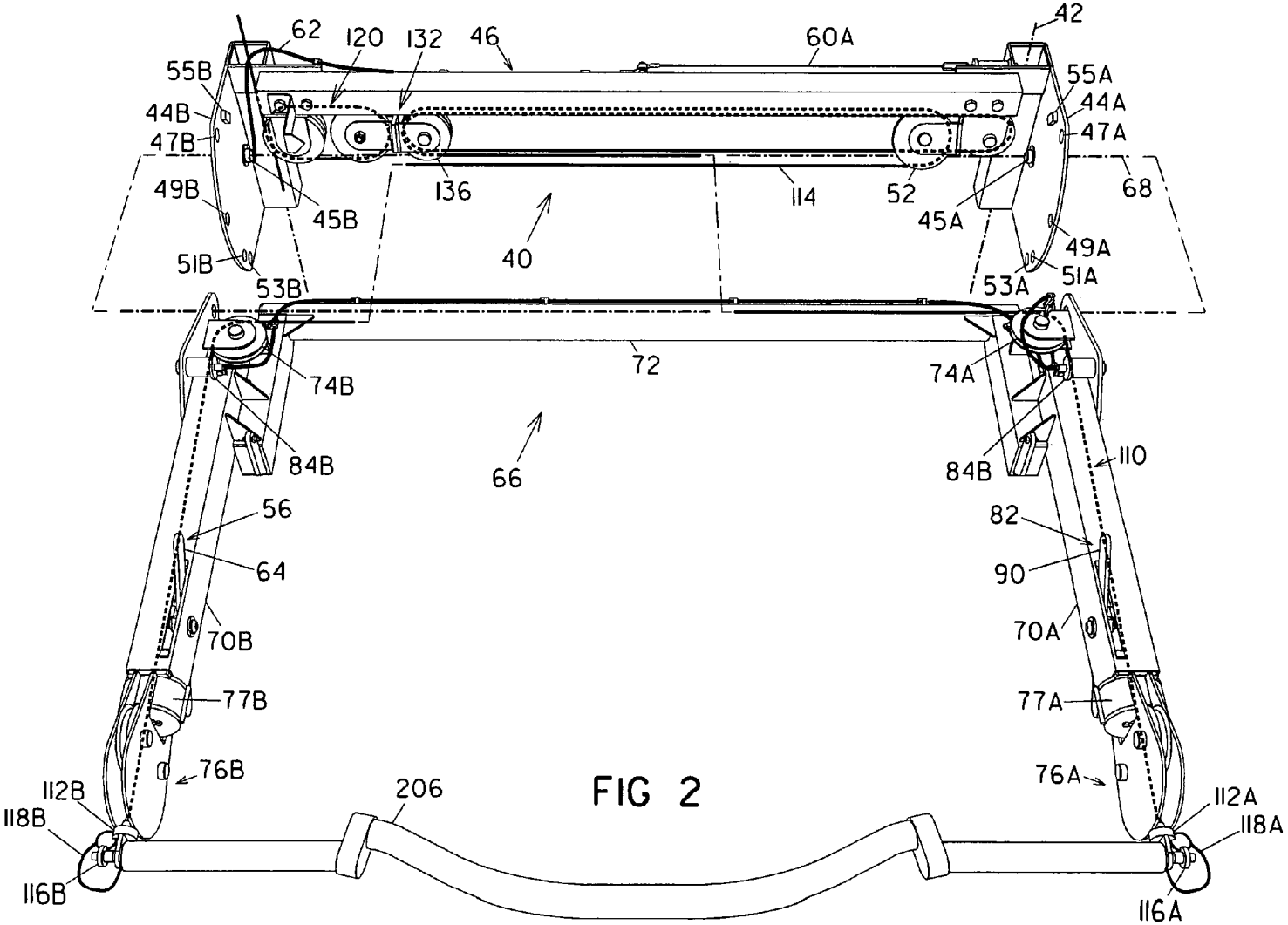
FIG. 2 is a front/top perspective view of an embodiment showing the arm assembly and guide assembly separated and shows the parts that make up each of the assemblies.
Figure 3:
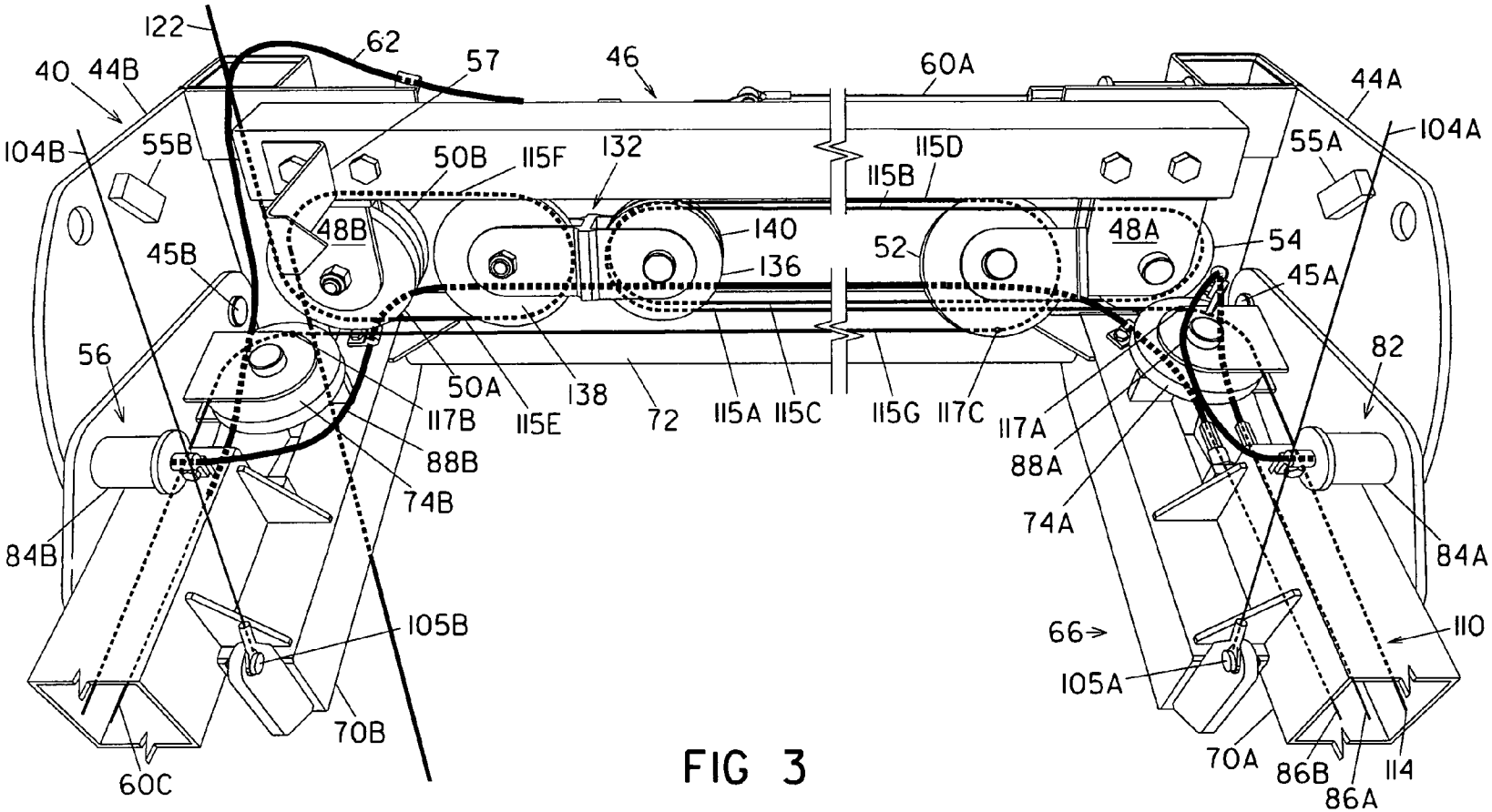
FIG. 3 is a front/top perspective view of an embodiment showing the arm and guide assemblies assembled together with the distal ends of the arm cut off for a more close up view.
Figure 4:
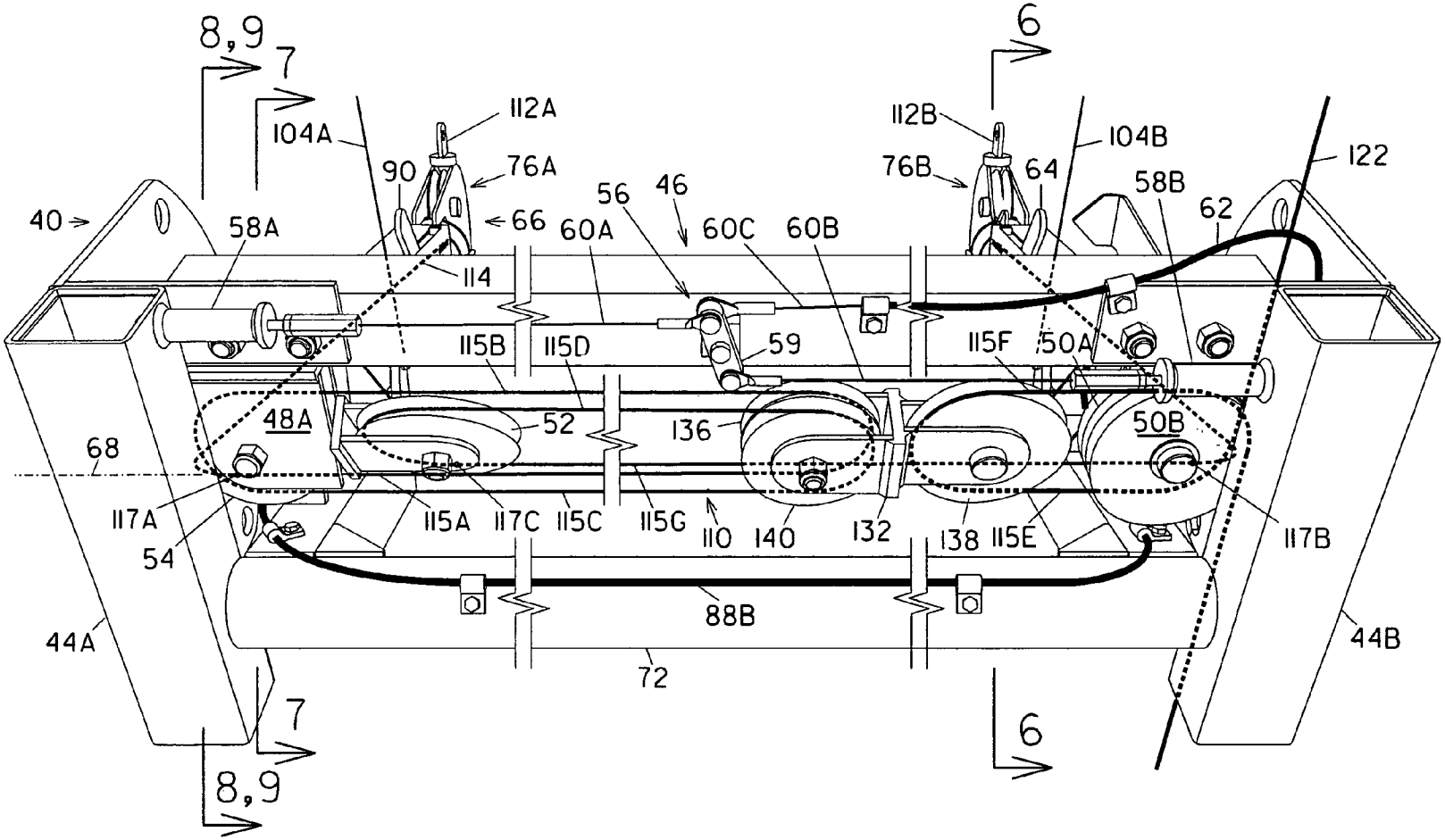
FIG. 4 is a rear/top perspective view of an embodiment of the arm and guide assemblies.

The arm assembly 66 is comprised of two arms 70A, 70B that are parallel to one another, have a pivot end and a distal end, and that are joined together by an optional connecting tube 72 near their pivot end. The arms 70A, 70B are pivotally attached at their pivot end to guide ends 44A, 44B of the guide assembly 40 at pivot pins 45A, 45B and these two pivot pins define an axis of rotation 68. Near the pivot end of the arm 70A is a first pulley 74A that is mounted so that the effective circumference of the pulley is essentially tangent to the axis of rotation 68. Likewise near the pivot end of the arm 70B is a second pulley 74B that is mounted so that the effective circumference of the pulley is small distance from being tangent to the axis of rotation 68. The distance is preferably less than a few centimeters and more preferably less than a few millimeters. At the distal ends of the arms 70A, 70B are mounted pulley assemblies 76A, 76B (FIGS. 2, 16) that are comprised of: a rotating structure 77A, 77B that allows them to be able to rotate about the centerline of the arms; and each has a sets of pulleys, 78A, 78B and 80A, 80B, positioned so that they are nearly touching, such that they keep captive any cable passing between them. The shape of the rotating structure 77A, 77B (FIG. 16) is designed such that preferably the length of any cable coming from between the pulleys 78A, 78B to the cable end 112A is substantially the same length regardless of where cable end 112A is positioned and so the length of cable segment 81A is substantially equal to the length of cable segments 81B and 81C. An optional rotation lock means 82 (FIGS. 2, 3, 4) provides a way to lock the rotation of the arm assembly 66 relative to the guide assembly 40 for different exercises and for storage. The rotation lock means 82 is comprised of lock pin assemblies 84A, 84B that are spring loaded pins that are located on the arms 70A and 70B near their pivot ends, connected via cables 86A, 86B that run inside of cable guide casings 88A, 88B to an activation lever 90 near the distal end of arm 70A, where they are pivotally attached at attachment point 89. As the activation lever 90 (FIGS. 17, 18) is rotated, attachment point 89 rotates to two different positions that are on opposite sides of pivot 87 and that are different distances 91A, 91B from pivot 87. When the activation lever 90 is positioned so that there is a distance 91B, then lock pin assemblies 84A, 84B are retracted and when the activation lever is positioned so that there is a distance 91A then the lock pin assemblies are extended allowing them to engage a plurality of holes 47(A,B), 49(A,B), 51(A,B), and 53(A,B) in the guide ends 44A, 44B (FIG. 2), which allow the arm assembly 66 to be locked in rotation to the guide assembly 40 in a number of useful locations. Stops 55A, 55B located on the guide ends 44A, 44B stop the arm assembly 66 from rotating past the top holes 47A, 47B.

A guide assembly 40 (FIGS. 1, 2, 3, 4) is comprised of guide ends 44A, 44B that are connected together by support bracket assembly 46. Guide end 44A is slideably connected to a left member, a frame guide element 144A, and guide end 44B is slideably connected to a right member, a frame guide element 144B, that allow the guide assembly 40 to translate vertically along an axis of translation 42. Pulley brackets 48A mounted on support bracket assembly 46 near guide end 44A houses a fourth pulley 54 and a pulley 52, which interact with an arm cable 114. Pulley brackets 48B mounted on support bracket assembly 46 near guide end 44B houses a pulley 50A and a pulley 50B, which interact with a resistance cable 122. Also attached to support bracket 46 is a pointer 57 and a pivot bar 59. An optional translation lock means 56 provides a way to lock the guide assembly 40 to frame guide elements 144A, 144B. The translation lock means 56 is comprised of lock pin assemblies 58A, 58B, that are shown as spring loaded pins that are located on the guide ends 44A, 44B, that are connected via cables 60A, 60B to the pivot bar 59 where they are pivotally connected. Also pivotally connected to the pivot bar 59 is a cable 60C that enters into cable guide casing 62. The cable guide casing 62 redirects the cable up and over support bracket assembly 46 to the pivot end of arm 70B. Cable 60C then exits the cable guide casing and runs inside of the arm where it pivotally attaches to an activation lever 64 near the distal end of the arm. The rotation of activation lever 64 is similar to the rotation of activation lever 90 described above. When the activation lever 64 is rotated it retracts or extends the lock pin assemblies 58A, 58B thereby locking the guide assembly 40 to guide elements 144A, 144B, which can have a plurality of holes located on them.

Frame assembly 142 (FIGS. 1,14,15) is comprised of frame guide elements 144A, the left member, and 144B, the right member, that are bolted at their bottom to a bottom frame assembly 148, and bolted at their top to a top frame assembly 146. This creates a structurally solid frame where frame guide elements 144A and 144B run parallel to one another. Top frame assembly 146 is the part of the frame assembly 142 that can come in contact with a wall 222, specifically at wall rest 155A and 155B. To mount the frame assembly 142 to the wall 222, first locate wall studs 224 and mark their centerlines at the correct height above the ground. The frame assembly 142 is positioned up against the wall 222 and then mounting brackets 151 are slid along grooved member 145 and positioned over the wall studs 224. Lag bolts 153 can be installed through the mounting brackets 151 into the wall studs, thus securing frame assembly 142 to the wall 222. The bottom frame assembly 148 is positioned so that frame guide elements 144A, 144B are an equal distance from the wall 222 along their length. Then brackets 157A, 157B, which have slotted mounting holes, are slid over to and contact the wall or baseboard 226 (FIGS. 15, 29) and are then secured there. Other components of the top frame assembly 146 and bottom frame assembly 148 are listed later in the description.

Resistance assembly 92 (FIGS. 1, 5) provides the resistance and can be comprised of a weight stack 94, a selector bar 95 that fits down through the center of the weight stack, a selector pin 96 that is able to engage a plurality of holes in the selector bar, and guide bars 98A and 98B, which confine and guide the weight stack. Alternatively, another source of force may be used such as one having non-gravity based resistance elements like those known to the art. Guide bars 98A, 98B are mounted at their top end to the top frame assembly 146 (FIG. 14) by way of top guide bar mounts 99A, 99B and at their bottom end to bottom frame assembly 148 (FIG. 15) by fitting over bottom guide bar mounts 97A, 97B.

Cable assembly means is for transferring force from the weight stack to the user interface areas. In this embodiment, cable assembly means 108 (FIGS. 2-10) transfers the resistance selected at the resistance assembly 92 to cable ends 112A and 112B that extend from the distal ends of the arms 70A, 70B and to a cable end 124B located at a leg extension 172. The cable assembly means 108 is comprised of a pulley block assembly 132 that has a first side and a second side, an arm cable assembly 110, and a resistance cable assembly 120. A third pulley 136 and a pulley 140 located on the first side of pulley block assembly 132 are in communication with arm cable assembly 110 that is in communication with cable ends 112A and 112B. A pulley 138 located on the second side of pulley block assembly 132 is in communication with resistance cable assembly 120 that is in communication with the resistance assembly 92 and cable end 124B at leg extension 172. The pulley block assembly 132 has cable segments 115 (A-D) in contact with it on its first side and cable segments 115E, 115F in contact with it on its second side. Pulley block assembly 132 is positioned in space so that the effective circumference of the third pulley 136 is tangent to the axis of rotation 68 (FIG. 8) and all of the cable segments 115(A-F) in contact with the pulley block assembly are substantially parallel with the axis of rotation 68. These six cable segments 115(A-F) come from first pulley 74A, fourth pulley 52, and pulley 54 on the first side, and pulleys 50A, 50B on the second side. Fourth pulley 52 and pulley 54 are housed in pulley bracket 48A, and pulleys 50A, 50B are housed in pulley bracket 48B. Pulley brackets 48A, 48B are both part of the guide assembly 40 and so don't move relative to the pulley block assembly 132 during rotation movement or translation movement. First pulley 74A, however, does rotate with the arm assembly 66, but its effective circumference is tangent to the axis of rotation 68 at a point of contact 117A that is the point at which cable segment 115A contacts first pulley 74A. So all six cables segments 115(A-F) remain parallel to one another regardless of whether arm assembly 66 rotates or guide assembly 40 translates. FIG. 10 is a schematic representation of the cable reeving shown in FIG. 5.

Figure 7:
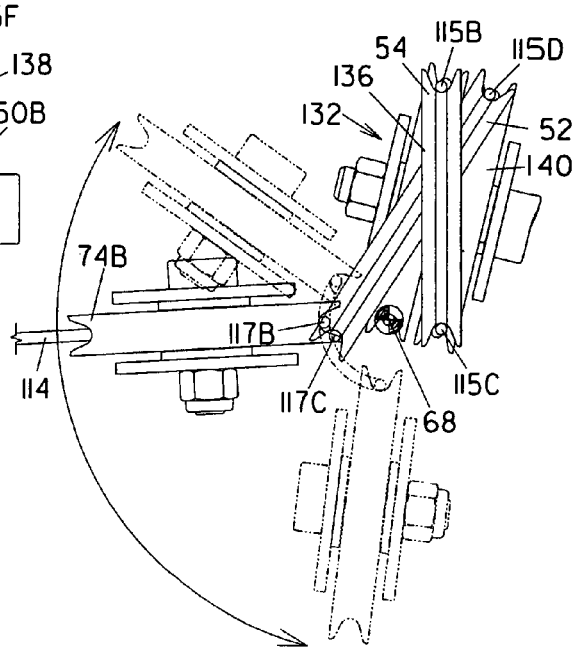
FIG. 7 is a section view from FIG. 4 and shows the relationship between the second pulley, the fourth pulley and the axis of rotation (pulley bracket 48A removed for clarity).
Figure 8:
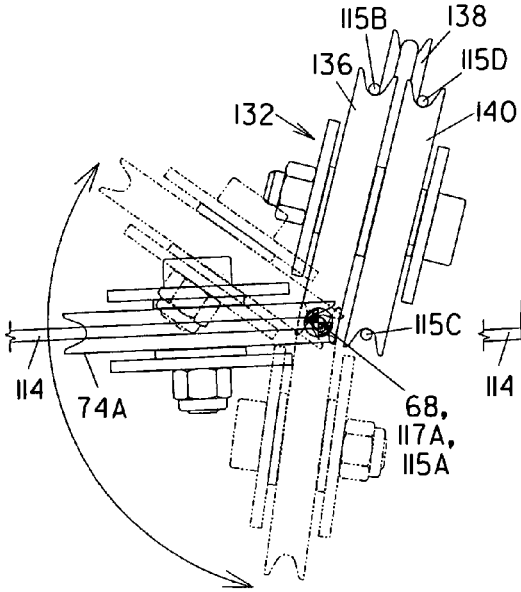
FIG. 8 is a section view from FIG. 4 and shows how the first pulley and the third pulley are tangent to the axis of rotation (Pulleys 52, 54 and pulley bracket 48A removed for clarity).
Figure 9:
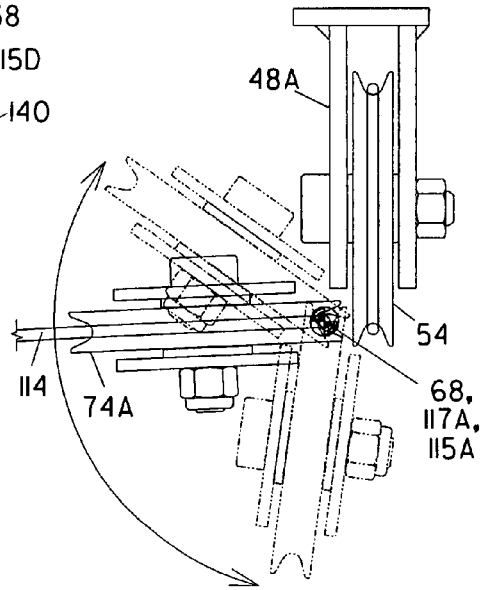
FIG. 9 is a section view from FIG. 4 and shows the clearance of the first pulley.

Arm cable assembly 110 (FIGS. 2-9) is comprised of arm cable 114 with cable ends 112A, 112B, which have attached to them quick release pins 116A, 116B by way of cable ties 118A, 118B. The cable ends 112A, 112B are designed as stops so that they cannot retract past the pulley assemblies 76A, 76B and back into the arms. Following arm cable 114 as it emerges from cable ends 112A at the distal end of arm 70A, first arm cable 114 passes between the pulleys 78A, 78B of pulley assembly 76A, through the inside of arm 70A, and then passes over first pulley 74A that is proximate to the pivot end of arm 70A. First pulley 74A is positioned such that cable 114 exits the pulley on the axis of rotation 68 at point of contact 117A and from here is defined as cable segment 115A. Cable segment 115A runs along the axis of rotation until it enters onto the third pulley 136 that also has its effective circumference tangent to the axis of rotation 68. Cable 114 wraps approximately 180 degrees around third pulley 136 and then exits as cable segment 115B were it runs substantially parallel to the axis of rotation 68 before wrapping approximately 180 degrees around pulley 54. Cable 114 then exits as cable segment 115C where it runs substantially parallel to the axis of rotation before wrapping approximately 180 degrees around pulley 140 and then exits as cable segment 115D. Cable segment 115D runs substantially parallel to the axis of rotation before wrapping approximately 180 degrees around fourth pulley 52 and then exits as cable segment 115G at point of contact 117C. From here cable segment 115G runs to the second pulley 74B that is proximate the pivot end of arm 70B and enters it at point of contact 117B. In this embodiment, the effective circumference of second pulley 74B cannot be tangent to the axis of rotation 68 or it would interfere with pulley 50A (FIG. 6) and so it is a small distance from it. There are two extreme positions for second pulley 74B (shown in phantom) and since it is not on the axis of rotation 68, point of contact 117B scribes an arc between the two extreme positions (FIG. 7). The point that cable segment 115G exits fourth pulley 52 (point of contact 117C) preferably is near the center of this arc so that the amount of change in cable length of cable segment 115G when the arm assembly 68 is rotated can be kept to a minimum. After arm cable 114 wraps around second pulley 74B it runs inside of arm 70B, through pulleys 80A, 80B of pulley assembly 76B and terminates at cable end 112B.

Resistance cable assembly 120 (FIGS. 2-6) is comprised of resistance cable 122, with a cable end 124A that bolts into selector bar 95 at the resistance assembly 92, a cable end 124B that is pivotally attached to a leg extension 172, and a cable stop 126 a short distance from cable end 124B. Following the resistance cable 122 as it emerges from cable end 124A at the resistance assembly 92, resistance cable 122 goes straight up to the top frame assembly 146 (FIG. 14) and over pulleys 150(A-C). Upon exiting pulley 150C, resistance cable 122 goes straight down, parallel with the axis of translation 42, where it wraps approximately 90 degrees around pulley 50A located on the guide assembly 40. Resistance cable 122 exits pulley 50A as cable segment 115E (FIG. 6), which runs substantially parallel with the axis of rotation 68, where it then wraps approximately 180 degrees around pulley 138 of the pulley block assembly 132. Resistance cable 122 exits as cable segment 115F, runs substantially parallel with the axis of rotation 68, and then wraps approximately 90 degrees around pulley 50B. Resistance cable 122 exits pulley 50B, runs parallel to the axis of translation 42 and heads straight down to the bottom frame assembly 148 (FIG. 15). There, resistance cable 122 wraps around a pulley 152A, pulley 152B and guide pulley 154 where the cable stop 126 that is attached to the resistance cable 122 rests against a pulley bracket 156, which prevents resistance cable 122 from retracting past this point. The resistance cable continues through cable stop 126 to its second cable end 124B that is pivotal connected to the leg extension 172.

Optional counterweight assembly 100 (FIGS. 3, 5, 14) offsets the combined weight of the arm assembly 66, guide assembly 40, and an exercise bar 206 to allow for easier rotation and vertical translation. In one embodiment, the counterweight assembly 100 is comprised of a counterweight 102 that is connected to the arm assembly 66 by counterweight cables 104A, 104B that go straight up from the counterweight 102 to the top frame assembly 146 where they wrap over pulleys 158(A-F) before coming down and pivotally attaching to the arm assembly 66 at pivots 105A, 105B. The counterweight 102 is partially enclosed by a counterweight guide 106 (FIG. 29) that is mounted at its top to a cove assembly 194 and at its bottom to the bottom frame assembly 148. The counterweight guide 106 is there to guide and protect the counterweight, and provides a place to mount holders 216(A-C) that can be used to hold different user interfaces when not in use.

The seat assembly can be collapsed into a near planar configuration in a closed or storage position and unfolded into a versatile support structure in an open position. As such, the seat assembly is suitable for many exercise machines besides ones encompassed by the invention. One embodiment of the seat assembly is seat assembly 160 (FIGS. 1, 21-24, 32) that is shown centered in the frame assembly 142 and is comprised of the components described below. Other embodiments are apparent to those of ordinary skill in exercise machines and are encompassed by the invention.

In the embodiment shown, a center member, guide tube 166, is pivotally connected at its top end to the top frame assembly 146, and at its bottom end is slideably and pivotally connected to a lower member 168 near its middle. The lower member 168 is pivotally attached at its bottom end to support brackets 178A, 178B of the bottom frame assembly 148 (FIG. 15), is slideably and pivotally attached at its middle to the guide tube 166, and is pivotally attached at its top end to a seat 164. The seat l64 is pivotally attached to the lower member 168 near its front end, is pivotally attached to a backrest 162 at its back end, is slideably connected to a thigh support 170 at its front end, and is lockable to the thigh support by lock pin 171B, which engages a plurality of holes in the thigh support. The backrest 162 is pivotally attached to the seat 164 at its bottom end, is slideably connected to the guide tube 166, and is lockable to the guide tube by lock pin 171A. Lock pin 171A engages hole 167A in the guide tube when seat assembly 160 is in its storage position and engages hole 167B, located below hole 167A on the guide tube, when the seat assembly is in its open position. A thigh support 170 is slideably and lockably connected to the seat 164, and is pivotally connected to a leg extension at its front end. The leg extension 172 is pivotally connected to thigh support 170 at its top end, is pivotally attached to cable end 124B at its bottom end, and is slideably and pivotally attached to fold down bracket 173 at its bottom end. Fold down bracket 173 is comprised of a frame 185 that is pivotally attached to the leg extension 172 at one end, and is pivotally attached to a support 186 near its middle. Support 186 is pivotally attached to the frame 185 at one end and is pivotally attached to a slide 187 at its other end. Slide 187 is slideably connected to the leg extension 172, is pivotally connected to support 186, and has a lock pin 171C that allows the slide to be locked in translation relative to the leg extension when the fold down bracket 173 is in an open position or a closed position. A backrest pad 163 is connected along the full length of backrest 162, a seat pad 165 is attached to seat 164, thigh cushions 180 slide onto thigh support 170, and ankle cushions 181 slide onto leg extension 172. Optional Roman chair arms 174A, 174B (FIGS. 21, 32, 33) are hinged at their bottom end to backrest 162 near its bottom end and have folding handgrips 177A, 177B pivotally attached near their free end. Folding handgrips 177A, 177B have lock pins 175A, 175B attached that allow them to be locked relative to the Roman chair arms 174A, 174B in a storage position that is substantially in line. with the Roman chair arms and also locked perpendicular to their storage position. The hinged joint of the Roman chair arms 174A, 174B allows them to be put into a storage position where they fold up on either side of the backrest pad 163 and are held in place by clipping the fold down brackets 177A, 177B (which need to be in their storage position) into arm support brackets 176A, 176B, which are mounted to the backrest pad 163 near its top end. When the Roman chair arms 174A, 174B are put in their open position, they fold down and away from the backrest 162 until they are approximately perpendicular to the backrest, at which point the hinged joints stops their rotation. A counterweight 182 slides inside of guide tube 166 and is connected to the backrest 162 by means of cable 183 that attaches at the top end of counterweight 182, travels up to a pulley 184 located in guide tube 166 near its top end, passes around the pulley and runs along the outside of the guide tube until it attaches to the backrest 162 near its top end at attachment point 179. An elastic member 188 is attached at one end to the resistance cable 122 midway between cable end 124B and cable stop 126, and at its other end to seat 164 near its back end.

An embodiment of a cabinet enclosure 191 is shown in FIGS. 25-29. The embodiment is comprised of six door panels 192(A-F) that surround the exercise apparatus, a cove assembly 194 to enclose the top frame assembly 146 (FIG. 30), a back panel 193, and a plurality of hinges discussed below. Cove assembly 194 mounts to the bottom of the top frame assembly 146 and has all the necessary holes and openings for all the cables and parts that need to reach the top frame assembly. Door panels 192A, 192B make up the sides of the cabinet-enclosure. Door panels 192A, 192B have mounted to their top end top frame hinges 196A, 196B that then mount to cove assembly 194 and top frame. assembly 146, and have mounted to their bottom end bottom frame hinges 198A, 198B that then mount to the bottom frame assembly 148. Four door panels 192(C-F) make up the front of the cabinet enclosure. Door panels 192C, 192D have mounted at their top on one side, top door hinges 200A, 200B, and have mounted at their bottom on the same side, bottom door hinges 202A, 202B and together are pivotally connected to the hinges that are mounted to door panels 192A, 192B. Door panels 192C, 192D are hinged on their other side at the back face to door panel 192E, 192F. The back panel 193 runs nearly the width and height of frame assembly 142 and helps to hide the cable reeving of the cable assembly means 108. Back panel 193 is mounted at its top to the cove assembly 194, at its bottom to the bottom frame assembly 148, and is located just behind the seat assembly 160 and in front of the guide assembly 40.

Four likely resistance-bearing user interfaces for the exercise apparatus embodiments under discussion are detailed below. A first is an exercise bar 206 that is able to attach to cable ends 112A, 112B (FIGS. 1, 20) with quick release pin 116A, 116B or that fits into holder 208 when not in use. A second is a pulldown bar 210 (FIGS. 29, 35) that has hooks 211A, 211B that allow it to hook over the top of exercise bar 206 for use on pulldown exercises and that fits into holder 212 when not in use. A third are handgrips 214A, 214B (FIGS. 19, 29, 33), which are able to attach to cable ends 112A, 112B with quick release pin 116A, 116B or which hook over holders 216A, 216B when not in use. A fourth is a leg strap 218 (FIG. 29), which is able to attach to either cable end 124A, 124B in a similar manner that handgrip 214A, does (FIG. 19) and which hook over holders 216C when not in use.

Operational Aspects

The versatility of the invention permits many exercises to be performed. The arm assembly 46 has two arms 70A, 70B a fixed distance apart that move in parallel planes that allow them to be connected together so that they can move as one unit. Since the arms can be connected together and pivot together on the same axis of rotation 68 this allows an exercise bar 206 to attach to cable ends 112A, 112B at the distal ends of the arms. The exercise bar is shaped for a variety of different exercises. The straight sections near its ends allow for exercises where gripping a straight bar is best, such as pressing exercises like the bench press. The curved area just inboard of the straight section allows the hands to be rotated for more comfort while doing an exercise like curls, but maintain the center of the hands on the centerline of the bar to eliminate torque on the exercise bar. The bulged area at the middle of the exercise bar 206 allows the bar to give extra clearance for body parts on some exercises such as room for the chest during the bench press or room for the legs during dead lifts.

In addition, various exercises can be performed with minimal change over time. The attachment of the exercise bar 206 to the cable ends 112A, 112B is made by pressing the button on the quick release pin 116A (FIG. 20) that allows it to be inserted through the cable end 112A and into the end of the exercise bar 206 where there is relief to allow the locking balls of the quick release pin to expand out and lock the pin to the exercise bar. The cable ends 112A, 112B are free to rotate around the axis of the quick release pins 116A, 116B and also have some side-to-side movement because of the spherical bearings that are a part of the cable ends. At the distal ends of the arms 70A, 70B are rotating pulley assemblies 76A, 76B that allow the cable ends 112A, 112B to be pulled from the pulley assemblies at a wide variety of angles, allowing for many different specialty type exercises to be performed when individual handgrips 214A, 214B or leg strap 218 is installed. The handgrips 214A, 214B and leg strap 218 install onto the cable ends 112A, 112B (FIG. 19) by inserting the spherical bearing of the cable ends between the two mounting plates of the handgrip and then inserting the quick release lock pin 116A through all three.

The cable assembly means is an important element of the versatility. The operation of the cable assembly means 108 is what allows the arm assembly 66 to rotate and the guide assembly 40 to translate without an appreciable change in cable length or tension of the resistance cable 122. Excessive movement would allow the selector bar 95 to move relative to the weight stack 94 and cause difficulty inserting the selector pin 96. All of the cable segments 115(A-F) (FIG. 3-5) that contact the pulley block assembly 132 are substantially parallel with the axis of rotation 68 allowing the pulley block to move without twisting. An acceptably slight change in cable length occurs because the point of contact 117C is not on the axis of rotation 68 (FIG. 7) and so the distance between contact points 117C and 117B vary as the arm assembly 66 is rotated.

There are several factors which effect the change in cable length of cable segment 115G. First, the closer that both contact points 117B and 117C are to the axis of rotation 68 the smaller the change in cable length. If one of them were on the axis of rotation there would be no change in cable length. Second, the larger the distance (in the direction of the axis of rotation) between the contact points 117B and 117C the smaller the change in the cable length. Third, the more centered that contact point 117C can be to the center of the arc of contact point 117B (FIG. 7) the smaller the change in cable length. For the embodiments shown, the maximum change in the cable length of cable segment 115G that is most preferred is 0.007 inches (0.2 millimeters). Since the pulley block assembly 132 has a 2:1 ratio between the arm cable assembly 110 and the resistance cable assembly 122. (discussed below), the maximum movement of the selector bar 95 is half of that distance, or 0.0035 inches (0.1 millimeters), an insignificant amount. The arrangement between pulleys 50A, 50B on the guide assembly 40 and the pulley 138 of block assembly 132 allows the guide assembly 40 to translate vertically without the pulley block assembly 132 moving. As the guide assembly 40 translates, the resistance cable 122 wraps on and off of the pulley block assembly 132 without effecting its relative position, or that of the selector bar 95.

The number of cable segments used also influences the versatility of the invention. In the structure discussed above, by having four cable segments 115(A-D) on the first side of pulley block assembly 132 and two cable segments 115(E,F) on the second side, a 2:1 ratio is created that divides the resistance of the weight stack 94 equally to each of the cable ends 112A, 112B. The cable block assembly 132 also allows each cable end 112A, 112B to be pulled independently from one another, which helps to give the machine the feeling of working out with free weights. Since the resistance of each cable end 112A, 112B is half the resistance of the weight 94, when both cable ends are pulled at the same time, the resistance is the same as what is selected on the weight stack, and the amount of travel available for each cable end is equal to the maximum travel of the weight stack. When an individual cable end 112A is pulled alone, the resistance is equal to half the weight selected on the weight stack 94 and the available travel is equal to twice the maximum travel of the weight stack. For a given exercise, by using an individual cable end 112A, the distance the weight stack 94 travels is half of what it would be when both cable ends 112A, 112B are pulled at the same time. This also makes the velocity of the weight stack during the exercise equal to half that experienced when both are pulled. Since the velocity of the weight stack 94 is half, the momentum of the weight stack is equal to a quarter of the momentum of pulling both cable ends 112A, 112B because momentum is affected by the square of the velocity of the weight stack. Performing specialty exercises with a single handgrip allows the perceived force at the handgrip to be more constant because of the reduced velocity, and therefore momentum, of the weight stack. The weight stack of a preferred embodiment has a total weight of 250 lb (113 kilograms) and a preferred amount of travel of over 51 inches (1.3 meters) or 125 lb (57 kilograms) and 102 inches (2.6 meters) at an individual handgrip. This should provide the necessary resistance and range of motion for the majority of users.

The translation lock means 56 and the rotation lock means 82 work in the same manner, by pulling on spring loaded lock pin assemblies 58A, 58B and 84A, 84B with cables that are attached to an activation levers 64,90. The lock pin assemblies are able to stay retracted (FIGS. 17, 18) by having the attachment point 89 of the activation lever 90 pass from one side of the pivot 87 to the other when activating the lever. This way the spring loaded cable 86A pulling on the activation point 89 keeps the activation lever 90 in the position selected. The difference between the distances 91A and 91B is the travel of the lock pin assemblies 58A, 58B and 84A, 84B.

The counterweight balances the arm and guide assemblies in rotation and translation to enhance speed of changeover. The weight of the counterweight 102 is equal, preferably, to the combined weight of the arm assembly 66, exercise bar 206, and guide assembly 40, which makes them essentially weightless in their vertical translation. The counterweight 102 via cables 104A, 104B attaches to the arm assembly 66 at pivots 105A, 105B. The location of these pivots 105A, 105B is at a location that balances the combined center of gravity of the arm assembly 66 and exercise bar 206 (when they are positioned horizontally) to the center of gravity of the guide assembly 40. This allows the arm assembly 66, with the exercise bar 206 attached, to be balanced in rotation with respect to the guide assembly 40. Because the arm and guide assemblies with the exercise bar or handgrips is balanced in both rotation and translation, they remain in whatever position they are left in (provided the arm assembly 66 is mostly horizontal) without the need to engage the rotation or translation lock means 56, 82.

Elements involving the leg extension are designed to enhance consistency of resistance during leg exercises and increase adjustability for various sized users. A preferred form of the fold down bracket 173 (FIG. 21) has a curved channel as part of frame 185 that keeps the resistance cable 122 a constant distance from the pivot of where the leg extension 172 is pivotally attached to the thigh support 170. This feature provides a constant resistance to the leg extension during use. The fold down bracket 173 folds out by pulling on lock pin 171C and then pulling on the distal end of frame 185 while moving slide 187 downward until lock pin 171C engage a hole at the bottom of leg extension 172. Optional elastic element 188 (FIG. 22-24) is there to pull on resistance cable 122, to move it up and off the floor when the seat assembly 160 is put into its storage position. Thigh support 170 is adjustable for different sized users by pulling on lock pin 171B located on seat 164 while the thigh support is moved in or out and then allowing the lock pin 171B to engage the nearest of a plurality of holes in the thigh support.

The typical footprint of the invention is small and unobtrusive. Some embodiments of the exercise apparatus can be enclosed in a cabinet enclosure 191 (FIG. 25-29) made from bi-fold door assemblies like those used on closet openings, with each door being approximately one foot wide. Since the enclosure has four doors in the front and one on each side, this is the area into which some embodiments can fit and therefore only takes up four square feet (0.37 square meters) of floor space. The actual footprint may differ for some embodiments depending on the size, spacing and configuration of elements used. To complete the look of the enclosure, a cove assembly 194 can cover the top frame assembly 146. The frame assembly 142 and cabinet enclosure 191 that has been described above is designed to mount a small fixed distance from the wall 222 with space available at the back of the bottom frame assembly 148 to allow the majority of base boards 226 and quarter round 228 from the standard home to fit through untouched. The movement of the front door panels 192(C-F) (FIG. 27) allows their easy placement along side the side door panels 192A, 192B while the exercise apparatus is being used.

The following paragraphs describe the operation of some embodiments of the exercise apparatus starting at FIG. 28 and transitioning through the different configurations through to FIG. 35.

FIG. 28 shows an exercise apparatus in the stored position, with the cabinet enclosure 191 installed.

FIG. 29 shows the exercise apparatus just after the front door panels 192(C-F) are opened and folded around to rest next to the side door panels 192(A, B) (FIG. 27). The seat assembly 160 is designed to have a gap between the backrest pad 163 and the seat pad 165 so that the arm assembly can be put into its storage position even when the exercise bar 206 is still installed. When putting the versatile exercise apparatus into the storage position, first the rotation lock means 82 and the translation lock means 56 need to be unlocked (FIG. 18) so that the arm assembly 66 and the guide assembly 40 are free to rotate and translate. The guide assembly 40 is slid up to the top most position against the top frame assembly 146. The arm assembly 66 is rotated down to its storage position while guiding the exercise bar 206 into the gap of the seat assembly 160. Then the rotation lock means 82 is locked (FIG. 17) by the activation lever 90. Counterweight guide 106 and back panel 193 help to hide the cable assembly means 108 (comprising a pulley block assembly 132, an arm cable assembly 110 and a resistance cable assembly 120 shown in FIG. 1), and the counterweight 102 (FIG. 5), and give the exercise apparatus a clean appearance. Holders 216 A-C are attached onto the counterweight guide 106 so that the handgrips 214A, 214B and leg strap 218 have a storage location when not in use. Likewise holder 208 is available to hold the exercise bar 206 and holder 212 is available for the pulldown bar 210.

FIG. 30 shows an embodiment of the exercise apparatus without the decorative cabinet 191, back panel 193, or counterweight guide 106 installed. To move the arm assembly 66 to the position shown in this figure from the position shown in the prior figure, first disengage the rotation lock means 82 by rotating the activation lever 90 to the unlock position (FIG. 18). Rotate the arm assembly 66 up to its highest position and then engage the translation and rotation lock means 56, 82 by rotating activation levers 64 and 90 to their lock position (FIG. 17), locking the guide assembly 40 in translation and the arm assembly 66 in rotation. At this position the counterweight 102 is in its lowest position. Stops 55A, 55B (FIG. 2) on the guide ends 44A, 44B prevent the arm assembly 66 from rotating past this highest position and prevent the arm assembly 66 from contacting the top frame assembly 146 or the cove assembly 194 if it were installed. The stops 55A, 55B also help to align the lock pin assemblies 84A, 84B with holes 47A, 47B in the guide ends. Cable ends 112A, 112B and exercise bar 206 are rotate from the top of the pulley assemblies 76A, 76B to the bottom so that pulldowns on the exercise bar can be performed. If the resistance selected on the weight stack 94 is higher than the weight of the user, then pull-ups, or leg lifts can be performed, without the exercise bar 206 moving.

FIG. 31 shows the exercise bar 206 lowered for doing exercises such as arm curls or upright rows. To get to this position from the prior figure requires that both activation levers 64, 90 be unlocked so that then the arm and guide assembly can be moved down to the position shown. Rotate the activation lever 90 (FIG. 2) to the lock position and rotate the arm assembly 66 to just below horizontal until the spring loaded pins from the lock pin assemblies 84A, 84B engage holes 49A, 49B that are located in the guide ends 44A, 44B. Then rotate the exercise bar 206 around to the top of the pulley assemblies 76A, 76B. Check the height of the bar and adjust if needed by pushing up or down on the arm assembly 66 and then engage the lock pin assemblies 58A, 58B by rotating activation lever 64 to its lock position.

FIG. 32 shows the exercises bar 206 in its lowest position and ready for doing exercises such as dead lifts or bent over rows. To get to this position from the prior figure all that is required is for the translation lock means 56 to be disengaged, the arm assembly 66 pushed down until the guide assembly 40 contacts the bottom frame assembly 148, and then the translation lock means is engaged again. When the arm assembly 66 is in this position, pulley assemblies 76A, 76B just clear the floor so that the exercise bar 206 may be as close to the ground as possible. This is the lowest position that the arm assembly 66 can be placed for this embodiment, and so likewise it is also the highest position that the counterweight 102 reaches. Also shown is the Roman chair arms 174A, 174B rotated down to their open position. With the folding handgrips 177A, 177B in their storage position, dips can be performed. The folding handgrips 177A, 177B can be rotated up by pulling on lock pins 175A, 175B and moving them to the upright position (seen in phantom). In this position the handles can be grasped by a user resting his forearms on the Roman chair arms 174A, 174B and putting his back against the backrest pad 163. Now abdominal exercises can be performed, such as raising the knees up to the chest. To move the exercise bar 206 out of the way while using the Roman chair arms 174A, 174B it could also be put in its storage position in the gap between the backrest pad 163 and the seat pad 165 (FIG. 29) or it could be put in its pulldown position (FIG. 30).

FIG. 33 shows the exercise apparatus with the seat assembly 160 folded out to its operational position and with the exercise bar 206 replaced by handgrips 214A, 214B. The arm assembly 66 and guide assembly 40 are moved into position from the prior figure by unlocking the rotation and translation lock means 56, 82 as described above, moving the arm and guide assemblies 66, 40 into position and then locking the lock means 56, 82. The arm assembly 66 is positioned with the lock pin assemblies 84A, 84B (FIG. 2) engaged in holes 53A, 53B so that bench fly exercises with the handgrips 214A, 214B can be performed. With the arm assembly 66 in this position, the pulley assemblies 76A, 76B just clear the cabinet enclosure 191 (if it were installed) when they rotate. The height position of the guide assembly 40 is dependent on the size of the user and on the preference of the user. To move the seat assembly to its operational position, first the Roman chair arms are folded back to there storage position alongside the backrest pad 163 and held there by arm support brackets 176A, 176B. The lock pin 171 A (FIG. 22-24) is pulled, releasing the backrest 162 to slide down the guide tube 166, while at the same time the seat 164 is pivoting out until it is approximately perpendicular to the backrest 162. Lock pin 171-A that is spring loaded, snaps into the bottom hole 167B in the guide tube 166. The counterweight 182 (FIG. 25-27) offsets the weight of the seat assembly 160 making it quite easy to move it up or down. If leg extensions or leg curls are going to be performed then the fold down bracket 173 of the leg extension 172 is folded out.

FIG. 34 shows the exercise apparatus in position to do bench pressing exercises. To get to this position from the previous figure, first change out the handgrips 214A, 214B with the exercise bar 206 and position it on top of pulley assemblies 76A, 76B. Release the translation and rotation lock means 56, 82 and pivot the arm assembly 66 straight out (it will stay without engaging the lock means). Now sit on the seat assembly 60, rotate the arm assembly 66 until the exercise bar 206 is in front of the chest and then engage the rotation lock means 82. Keep rotating the arm assembly 66 until lock pin assemblies 84A, 84B engage holes 51A, 51B (see FIG. 2) located in guide ends 44A, 44B. The bulged out area of the exercise bar 206 fits around the chest and allows for the hands to be positioned further behind the chest than a straight bar would allow. The guide assembly 40 is now moved up or down depending on the size of the user and user preference and then the translation lock assembly 56 is engaged. The position of pointer 57 points to a graduated scale on the counterweight guide 106. If the vertical position of the guide assembly 40 is know from prior exercises, then the guide assembly can be locked prior to the arm assembly 66. Because the arm cable assembly 110 exits the pulley assemblies 76A, 76B at the shoulder joint of the user, it is possible to go from doing a decline bench press, to performing an incline bench press, and then doing a military press without ever adjusting the position of the arm or guide assemblies (FIG. 1).

FIG. 35 shows the exercise apparatus in position for doing pulldowns and/or leg exercises. To get to this position from the previous figure all that needs to be done is to disengage the translation and rotation lock means 56, 82, rotate the exercise bar 206 to the bottom of the pulley assemblies 76A, 76B, position the guide assembly to its highest position and engage the translation lock means 56, pivot the arm assembly 66 to its highest position, and engage the rotation lock means 82. The pulldown bar 210 is installed onto the exercise bar 206 by hooking it over the exercise bar with its hooks 211A, 211B. Since the fold down bracket 173 is already down, all the user needs to do to perform leg curls or leg extensions is to choose a weight and perform the exercise.

Additional Alternative Embodiments

Several additional cable assemblies are also described. FIG. 11 is a schematic representation of an alternative cable assembly means that has two pulley blocks as part of the pulley block assembly 132 and two arm cables as part of the arm cable assembly 110, each starting at a cable ends 112A or 112B at the distal ends of the arm assembly 66 and terminating on the guide assembly 40 after first wrapping around a pulley on a pulley block. The functionality and operation of this embodiment are the same as the embodiment schematically represented in FIG. 10 and discussed earlier, as is the relationships between the first, second, third, and fourth pulleys 74A, 74B, 136 and 52, respectively.

FIG. 12 is a schematic representation of an alternative cable reeving method that has a pulley block assembly 132 running horizontally other that between the arms of the arms assembly. After the arm cable 114 exits the third and fourth pulleys 136, 52 they travel vertically (in opposite directions) to pulleys on the frame, which then direct the arm cable to the horizontally running pulley block assembly 132. The functionality and operation of this embodiment are the same as the embodiment schematically represented in FIG. 10, as is the relationships between the first, second, third, and fourth pulleys 74A, 74B, 136 and 52, respectively, except that the second pulley 74B and the fourth pulley 52 are both also on the axis of translation 68, and connecting tube 72 (FIG. 1) should now be in front of pulleys 74A, 74B.

FIG. 13 is a schematic representation of an alternative cable reeving method that has a pulley block assembly 132 running vertically. After the arm cable 114 exits the third and fourth pulleys 136, 52 they travel vertically (in opposite directions) to pulleys on the frame, which then direct the arm cable to the vertically running pulley block assembly 132. The functionality and operation of this embodiment are the same as the embodiment schematically represented in FIG. 10, as is the relationships between the first, second, third, and fourth pulleys 74A, 74B, 136 and 52, respectively, except that the second pulley 74B and the fourth pulley 52 are both also on the axis of translation 68, and connecting tube 72 (FIG. 1) should now be in front of pulleys 74A, 74B.

Another possible embodiment for the seat assembly 160 is to use an extension spring to offset the weight of the seat assembly instead of the counterweight 182. This allows for a greater amount of pull on the cable 183 when the seat assembly 160 is in its open position, when the greatest amount of pull is needed.

Another possible embodiment for the rotation lock means 82 would be to have a ratcheting mechanism instead of the lock pin assemblies 84A, 84B. Linear motion solenoids could also take the place of the lock pin assemblies 84A, 84B and 58A, 58B, in which case some sort of switch would take the place of the activation levers 64, 90. The vertical translation means could be a wedging mechanism such that when force is applied to the ends of the arms this causes guide ends 44A, 44B to be wedged against the frame guide elements 144A, 144B, which would prevent their vertical translation. Or an automatic lock pin assemblies (either electrical or mechanical) could be employed that would lock both the rotation and translation when a certain amount of weight is exerted on a cable.

As can be seen, the exercise apparatus of this invention is a highly versatile exercise machine capable of providing a full body workout to the vast majority of users at a single workout station. An exercise apparatus that simulates a free weight lifting experience by using a weight stack for resistance, by not controlling the path of motion of the user interfaces and allowing the cable ends to act independently from one another. And when the workout is done, the exercise apparatus stores out of sight in a decorative cabinet that takes up a minimal amount of floor space.

Although the description above contains detailed descriptions of some embodiments, the details should not be construed as limiting the scope of the invention but as merely providing some of the presently preferred embodiments of this invention. Thus the scope of the invention is meant to be determined by the appended claims and their legal equivalents, rather than by the examples given.

I claim:

1. An apparatus comprising:

a guide assembly able to slide along a guide path, having an axis of translation parallel to said guide path, and having a first guide end and a second guide end;

an arm assembly pivotally coupled to said guide assembly, having an axis of rotation perpendicular to said axis of translation, and comprising a first arm including a distal end and a pivot end pivotally coupled to the first guide end at the axis of rotation, a second arm including a distal end and a pivot end pivotally coupled to the second guide end at the axis of rotation, a first pulley assembly comprising a first rotating structure rotationally attached to the distal end of the first arm and that contains at least one pulley, and a second pulley assembly comprising a second rotating structure rotationally attached to the distal end of the second arm and that contains at least one pulley;

a resistance assembly comprising a source of force and a selective means of engaging a portion of said source of force; and a cable assembly means for transferring force and allowing rotation and translation, comprising a first cable end positioned adjacent to the first pulley assembly and a second cable end positioned adjacent to the second pulley assembly, such that the first cable end and the second cable end are in communication with the resistance assembly and remain substantially at the same location adjacent the pulley assemblies during rotation of the first and second arms and translation of the guide assembly without substantially engaging the resistance assembly and without the need to perform any secondary operations.

2. The apparatus of claim 1, further comprising, a frame, comprising, a first frame element and a second frame element that are substantially parallel to one another, wherein said first guide end is slideably connected to said first frame element and said second guide end is slideably connected to said second frame element; and a top frame assembly and a bottom frame assembly, wherein said first frame element and said second frame element mount between them.

3. The apparatus of claim 2 wherein said guide assembly further comprises a locking means for locking the translation of said guide assembly relative to said frame at a plurality of locations.

4. The apparatus of claim 1 wherein said arm assembly further comprises a connecting tube for connecting said first arm and said second arm proximate their pivot ends such that both arms are able to rotate together and translate together.

5. The apparatus of claim 1 wherein said arm assembly further comprises, a first pulley proximate the pivot end of said first arm that has an effective circumference that is substantially tangent to said axis of rotation, and a second pulley proximate the pivot end of said second arm that has an effective circumference that is approximately tangent to said axis of rotation.

6. The apparatus of claim 5, further comprising, a third pulley that is in communication with said first cable end and that has an effective circumference that is substantially tangent to said axis of rotation, and a fourth pulley that is in communication with said second cable end and that has an effective circumference that is approximately tangent to said axis of rotation.

7. The apparatus of claim 6 wherein, said first cable end further comprises a first cable segment that runs from said first cable end, wraps around said first pulley, exits the pulley substantially parallel to said axis of rotation, and then wraps onto said third pulley; and said second cable end further comprises a second cable segment that runs from said second cable end, wraps around said second pulley, exits the pulley substantially parallel to said axis of rotation, and then wraps onto said fourth pulley, whereby the arm assembly is able to rotate without appreciably changing the cable length between the first pulley and the third pulley and without appreciably changing the cable length between the second pulley and the fourth pulley.

8. The apparatus of claim 1 wherein said arm assembly, further comprises, a locking means for locking the rotation of said arm assembly relative to said guide assembly at a plurality of rotations.

9. The apparatus of claim 1 wherein said cable assembly means further comprises a pulley block assembly that is free to translate and contains at least two pulleys, an arm cable assembly that contains said first cable end and said second cable end, and is in communication with at least one pulley in said pulley block assembly, and a resistance cable assembly that is in communication with said resistance assembly and is in communication with at least one pulley in said pulley block assembly.

10. The apparatus of claim 9 wherein said pulley block assembly comprises a first side and a second side where any pulley contained on said first side communicates with said arm cable assembly and any pulley contained on said second side communicate with said resistance cable assembly.

11. The apparatus of claim 1 wherein the cable assembly means further comprises a first user interface with a first bar end and a second bar end that are pivotally connectable to said first cable end and said second cable end or a second user interface comprising at least one hand grip pivotally connectable to either said first cable end or said second cable end.

12. The apparatus of claim 1 wherein said force source comprises a confined weight stack or non-gravity based resistance elements.

13. The apparatus of claim 1, further comprising, a counterweight assembly comprising, a counterweight means for applying a counterbalancing force that is in communication with said arm assembly, wherein said counterweight means has sufficient force to counterbalance the weight of said arm assembly and the weight of said guide assembly in order to allow them to be able to translate with minimal resistance;

a counterweight cable assembly that is in communication with said counterweight means and pivotally connects to said arm assembly a predetermined distance from the pivotal end.

14. The apparatus of claim 1, further comprising, a guide tube having a member, a backrest having a top and a bottom wherein the backrest is slideably attached to the guide tube, and a seat having a top and a bottom, where the top of the seat is rotateably attached to the bottom of the backrest to permit an alignment that is substantially perpendicular to the backrest in an open position and substantially parallel to the backrest in a closed position, wherein the seat in the open position is suitable to be sat upon and in a closed position is suitable for storage in a space having minimal depth.

15. An exercise apparatus, comprising, a structural support having an upper support point and a lower support point, where the upper support point is substantially vertical from the lower support point;

a frame having a left, center, and right member wherein the left and right members are substantially parallel to each other, substantially vertical and substantially straight, and the center member has a top end that is pivotally attached to the upper support point of the structural support so that said center member can pivot from an angular position to a vertical position;

a guide assembly able to slide along a guide path formed by the left member and the right member, having an axis of translation parallel to the guide path, and having a first end and a second end;

an arm assembly pivotally coupled to the guide assembly, having an axis of rotation, the rotation sufficient to permit positions suitable for exercise activity when in an open position and alignment substantially parallel and proximate to the plane of the guide assembly when in a closed position, and comprising a first arm and a second arm, each containing a pivot end proximate its pivot point and a distal end;

a resistance assembly comprising a source of force and a selective means of engaging a portion of said source of force;

a cable assembly means for transferring force, comprising a first cable end extending from the distal end of said first arm and a second cable end extending from the distal end of said second arm, such that said first cable end and said second cable end are in communication with said source of force and are able to be moved independently of each other;

a backrest having a top and a bottom wherein the backrest is slideably attached to the center member;

a seat having a front end and a back end, where the back end of the seat is rotateably attached to the bottom of the backrest to permit an alignment that is approximately perpendicular to the backrest in an open position and substantially parallel to and in line with the backrest in a closed position; and a lower member having a top and a bottom, where the top is pivotally attached to the front end of the seat;

wherein the exercise apparatus in the open position is suitable for exercise activity and in a closed position is suitable for storage in a space having minimal depth.

16. The arm assembly of claim 15, wherein the guide assembly first end is slideably attached to the right member and the guide assembly second end is slideably attached to the left member, wherein the axis of rotation of the arm assembly is perpendicular to the axis of translation of the guide assembly, and wherein the arm assembly further comprises a first element connecting the first arm and second arm proximate their pivot end.

17. The apparatus of claim 15, further comprising, a decorative covering at least partially covering apparatus when apparatus is in the closed position.

18. The apparatus of claim 17 wherein the covering is a cabinet with a fully retractable front that is capable of concealing the apparatus in the closed position.

19. An exercise apparatus, comprising, a resistance assembly comprising a source of force, a means of engaging said source of force and a means for transferring said source of force;

a structural support having an upper support point and a lower support point, where the upper support point is substantially vertical from the lower support point;

a center member that has a top end and a bottom end, wherein the top end is pivotally attached to the upper support point of the structural support so that said center member can pivot from an angular position to a vertical position;

a backrest having a top and a bottom wherein the backrest is slideably attached to the center member;

a seat having a front end and a back end, where the back end of the seat is rotateably attached to the bottom of the backrest to permit an alignment that is approximately perpendicular to the backrest in an open position and substantially parallel to the backrest in a closed position, and a lower member having a top, a bottom and a center section, where the top of the lower member is pivotally attached to the seat near the front end of the seat, where the center section of the lower member is slideably and pivotally attached to the bottom end of the center member and where the bottom of the lower member is pivotally attached to the lower support point of the structural support.

20. The exercise apparatus of claim 19, further comprising, a counterweight means to offset the weight of the backrest and the seat in order to allow them to be able to be moved between their open and closed positions with minimal effort.

* * * * *